US009139274B2

(12) United States Patent
West

(10) Patent No.: US 9,139,274 B2
(45) Date of Patent: Sep. 22, 2015

(54) REMOVABLE SHOE ATTACHMENT SYSTEM

(76) Inventor: Stephen R. West, Hamburg (DE)

( * ) Notice: Subject to any disclaimer, the term of this patent is extended or adjusted under 35 U.S.C. 154(b) by 720 days.

(21) Appl. No.: 13/321,665

(22) PCT Filed: May 21, 2010

(86) PCT No.: PCT/EP2010/003134

§ 371 (c)(1),
(2), (4) Date: Nov. 21, 2011

(87) PCT Pub. No.: WO2010/133378

PCT Pub. Date: Nov. 25, 2010

(65) Prior Publication Data

US 2012/0066934 A1 Mar. 22, 2012

Related U.S. Application Data

(60) Provisional application No. 61/213,270, filed on May 22, 2009, provisional application No. 61/318,893, filed on Mar. 30, 2010.

(51) Int. Cl.

| | |
|---|---|
| ***A63B 69/06*** | (2006.01) |
| ***A63B 71/00*** | (2006.01) |
| ***B63H 16/02*** | (2006.01) |
| ***A43C 15/16*** | (2006.01) |

(Continued)

(52) U.S. Cl.

CPC ..... *B63H 16/02* (2013.01); *A43B 1/0054* (2013.01); *A43B 3/246* (2013.01); *A43B 5/00* (2013.01); *A43B 13/10* (2013.01); *A43C 15/161* (2013.01); *A43B 3/00* (2013.01); *A43B 3/0005* (2013.01); *A43B 5/14* (2013.01); *B63B 2231/30* (2013.01)

(58) Field of Classification Search

CPC ..... A43C 15/161; A43B 13/10; A43B 5/00; A43B 3/00; A43B 3/0005; A63B 21/00192

USPC ..... 36/134, 132, 136, 114, 131, 107; 482/72

See application file for complete search history.

(56) References Cited

U.S. PATENT DOCUMENTS 4,118,034 A * 10/1978 O'Brien ..... 473/217
5,473,963 A * 12/1995 Aeschbach ..... 74/594.6

(Continued)

FOREIGN PATENT DOCUMENTS

AU 752277 B2 * 9/2002
DE 102004050664 B3 * 3/2006

*Primary Examiner* — Clinton T Ostrup
*Assistant Examiner* — Cameron A Carter
(74) *Attorney, Agent, or Firm* — Antonio Papageorgiou, Esq.; Meister Seelig & Fein LLP

(57) ABSTRACT

An attachment system for attaching shoes having toe and heel areas to a wide variety of sports equipment, in particular to a rowing boat or a rowing machine. The system includes an attachment device that is connected to or otherwise a part of the equipment, and a shoe block assembly that accepts the attachment device. These parts generally removably lock together for use of the equipment, which provides users custom features, better control over the force applied to the equipment via the shoe, and automatic emergency functions. An adjustment device generally fits into the shoe block assembly and is fixed to the shoe block assembly with screws or any other attachment methods, or could be formed as a part of the shoe block assembly, and the shoe block assembly is removably attachable to the attachment device by magnetic force or non-magnetic devices.

14 Claims, 35 Drawing Sheets

(51) Int. Cl.

| | |
|---|---|
| ***A43B 13/10*** | (2006.01) |
| ***A43B 5/00*** | (2006.01) |
| ***A43B 1/00*** | (2006.01) |
| ***A43B 3/24*** | (2006.01) |
| *A43B 5/14* | (2006.01) |
| *A43B 3/00* | (2006.01) |

(56) References Cited

U.S. PATENT DOCUMENTS

| | | | | |
|---|---|---|---|---|
| 5,704,256 | A * | 1/1998 | De Lattre | 74/594.6 |
| 7,219,451 | B2 * | 5/2007 | Chretien | 36/131 |
| 2003/0224676 | A1 * | 12/2003 | Takahashi | 441/74 |
| 2005/0022428 | A1 * | 2/2005 | Anderson | 36/50.1 |
| 2005/0188567 | A1 | 9/2005 | Chretien | |
| 2006/0197311 | A1 * | 9/2006 | Flaig | 280/611 |
| 2009/0113761 | A1 * | 5/2009 | Goldberg | 36/103 |
| 2009/0165336 | A1 * | 7/2009 | Anderson | 36/103 |
| 2009/0241827 | A1 * | 10/2009 | Matsueda et al. | 114/363 |
| 2009/0288316 | A1 * | 11/2009 | Fullerton et al. | 36/116 |
| 2010/0025967 | A1 * | 2/2010 | Flaig | 280/612 |

* cited by examiner

Fig. 5B
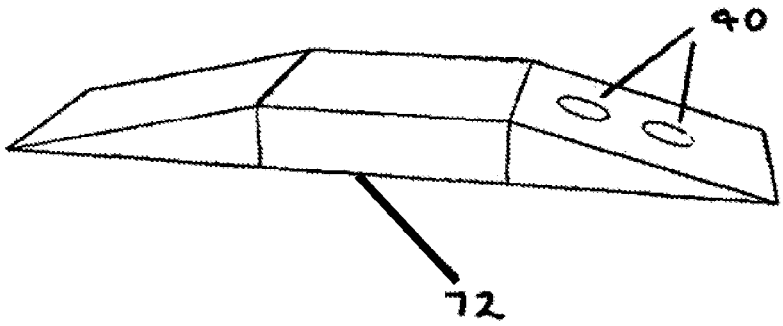
Fig. 5C
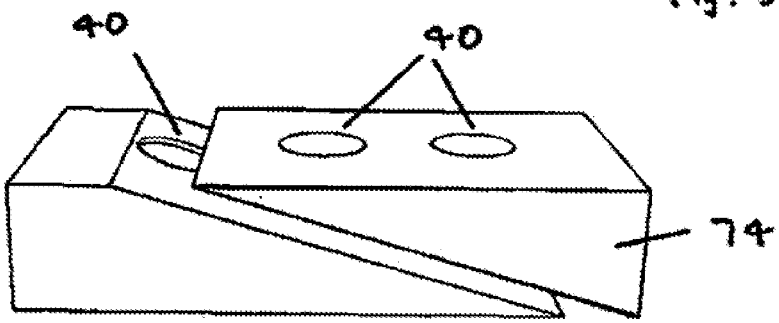
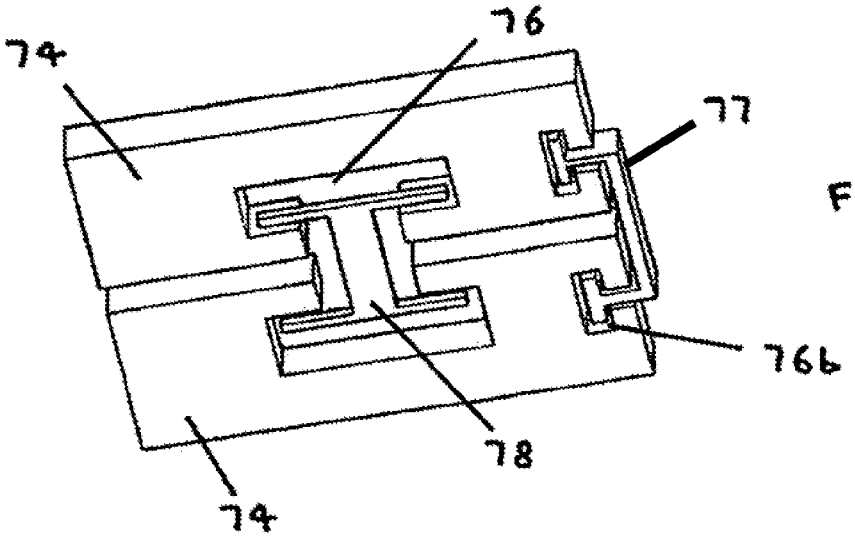
Fig. 5D

REMOVABLE SHOE ATTACHMENT SYSTEM

This application is a National Phase entry of PCT International Application, Serial No. PCT/EP2010/003134, filed May 21, 2010, which claims priority from Provisional Application No. 60/213,270, filed May 22, 2009, and Provisional Application No. 61/318,893, filed Mar. 30, 2010, which are each incorporated herein by reference.

BACKGROUND

1. Field

The present application relates to attachment systems for attaching shoes to a wide variety of sports equipment.

Some items of sports equipment like indoor rowing machines, cycling machines and recreational sports rowing boats use straps for removably attaching sports shoes during use. Competition rowing boats generally have permanently attached shoes. A firm attachment offers better control over the piece of equipment, but safety issues can arise as a result. Examples for such devices are described in US 2009/0241827 A1 showing a rowing boat footrest assembly; or in US 2005/0188567 A1, disclosing a fastening device for bicycle pedals.

Although the attachment system will be discussed herein for use with rowing boats, to aid the reader, it is understood that the attachment system can be used with other types of recreational and/or sporting equipment and is therefore not limited to the specific uses discussed herein. I will describe that application in detail. In most cases this description will cover indoor rowing machines, which require a similar bodily movement for their operation.

2. Related Art

Others have attempted to invent ways for removably attaching shoes to sports equipment, but their inventions had shortcomings due to one or more of the following reasons:

They were cumbersome.

They introduced new and undesirable directional movement of the feet.

They were not easy to retrofit to existing sporting equipment.

They were designed for use with conventional sports shoes.

The safety features portrayed were unconvincing.

None of them has gained acceptance in the marketplace.

Accordingly, there is a need for shoe attachment systems which do not exhibit one or more of the noted shortcomings.

SUMMARY

In accordance to one embodiment an attachment system is described in claim 1.

An attachment system is therefore provided with one or more embodiments discussed herein that has one or more of the following advantages:

Small and more convenient system.

More controlled foot movement.

Easier to retrofit to existing equipment.

Users can wear their own pair of shoes on land and on water.

More reliable detachment of the shoes in an emergency.

Enhanced feeling for the boat or equipment.

Improved rowing stroke efficiency.

Faster rowing readiness on the water.

Enhanced comfort.

Foot pivoting function available.

Possible therapeutic effect.

These and other advantages of one or more aspects will become apparent from a consideration of the description and accompanying drawings.

BRIEF DESCRIPTION OF THE DRAWINGS

FIG. 5B shows a wedge.

FIG. 5C shows two wedges.

FIG. 5D shows in cross-section a means to moveably couple two wedges or blocks.

REFERENCE NUMERALS

Figure 1A:
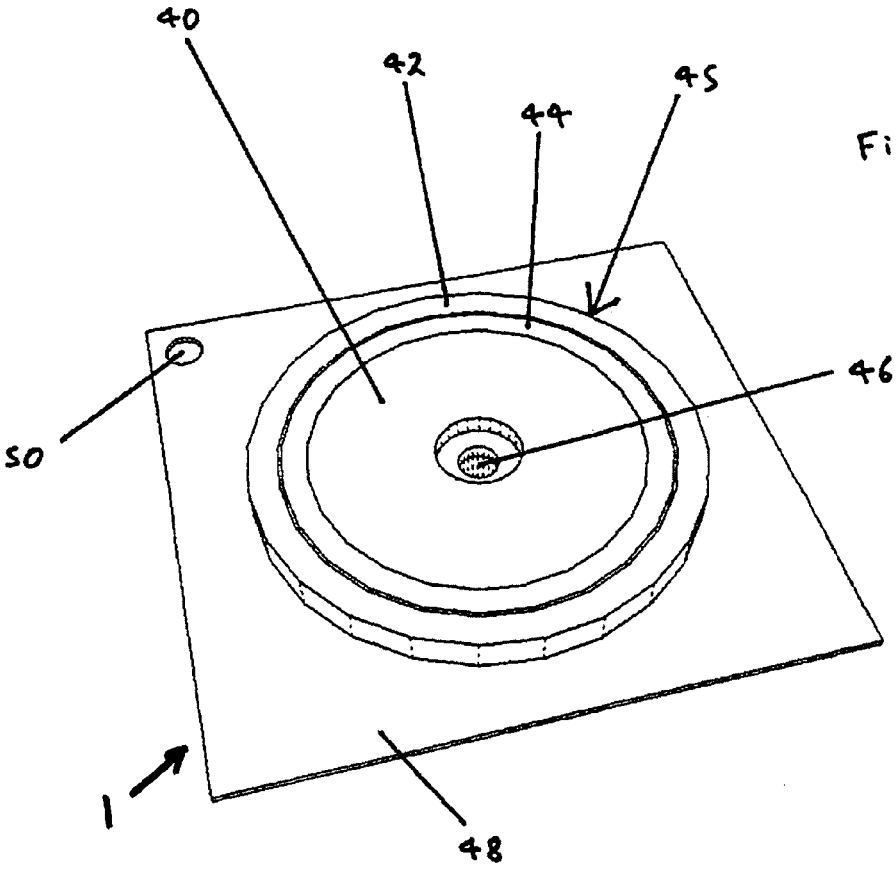
FIG. 1A is a perspective view of an attachment device.

1 attachment device
2 adjustment device
3 shoe block assembly
40 rare-earth magnet 100 steering block
42 ferrous metal pot 102 alignment block
44 non-ferrous filler 104 cylindrical form
45 magnetic system 106 stopper block
46 mounting hole 108 alignment hollow
48 base plate 110 groove in cylinder
50 hole 50' 112 ring
52 cap 114 concave surface
54 attachment plate 116 circular sector
56 cap base 118 mounting block
58 channel 120 ferrous metal strip
62 recess 122 mounting block lip
64 attachment plate recess 124 spring clip
66 shoe block 125 sole of shoe
68 ferrous counter plate 126 dirt cover sector
70 button 128 sliding hatch
72 pyramid 130 groove in block
74 wedge 132 cap cover
76 guide channel 134 finger grip
77 slide 136 grip surround
78 pin 138 engagement piece
80 periphery of magnetic system 140 alignment stud
82 receptacle for pyramid 142 receiving form
84 cap button 144 alignment hole 86 mounting arrangement 146 sleeve
87 slot 148 alignment arc
88 spring plunger 88' 150 nipple
90 restraining segment 152 scallop
92 lug 154 alignment recess
94 pivotal attachment 156 convex protrusion
96 cap wall 158 alignment segment
98 spindle 160 shoe support

DETAILED DESCRIPTION

Although specific embodiments will be discussed herein having specific elements and specific combination of elements, it is understood that all of the individual elements of the various embodiments can be combined to form other embodiments not specifically discussed herein.

Accordingly, the systems disclosed herein are not limited to the specific embodiments discussed herein.

FIGS. 1-4

First Embodiment

This system disclosed herein generally includes an attachment part or device 1 that is connected to or otherwise a part of the equipment, an adjustment device 2, and a shoe block assembly 3 that accepts the adjustment device 2, and the attachment part. These parts generally removably lock together for use of the equipment, which provides users better control over the force applied to the equipment via the shoe.

FIG. 1A shows a perspective view of an attachment device 1. A rare-earth magnet 40 or any other type of magnet is encased in a ferrous metal pot 42, separated by a non-ferrous filler 44 made of nylon or another suitable material. I term this construction a magnetic system 45 and it can be of any suitable shape. Magnetic system 45 can be attached e.g. to a base plate 48 of any shape or size using a mounting hole 46 and a bolt, or by another suitable method. Base plate 48 can be attached to a sporting device or equipment in a suitable way. Here one hole 50 is shown; however, more holes can be provided, or other ways can be used for its attachment to the equipment. Note, although the parts are discussed as being attached to the equipment or shoe, it is understood that the parts may be attached in the reverse.

The upper surface of magnet 40 can be flush with the outer wall of metal pot 42 or it can be lower or higher. Magnetic system 45 can have a protective surface treatment.

Filler 44 can be used solely around the periphery or solely on the base of magnet 40, or both.

Figure 3:
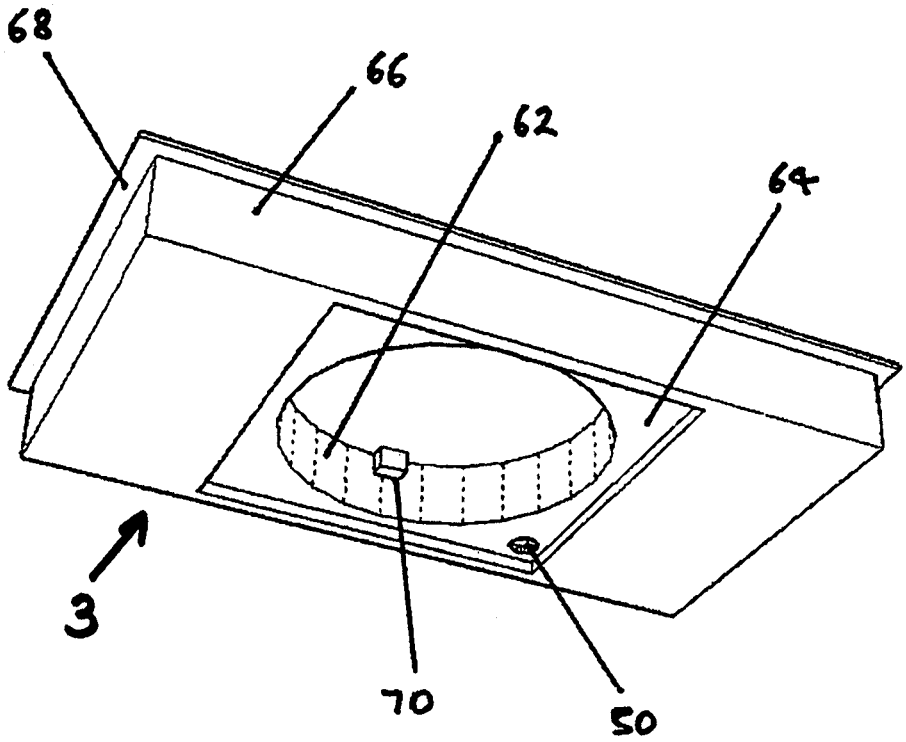
FIG. 3 is a perspective view of a shoe block assembly.

Magnetic system 45 is designed to achieve a strong magnetic force that will attract a corresponding part on the shoe block assembly of FIG. 3, on, or in the shoe. The magnetic material chosen can be from any suitable material such as Neodymium, Samarium Cobalt or indeed another material, which includes any that are not yet readily available. The shape and form of magnetic system 45 is not restricted to the cylindrical shape shown.

Base plate 48 can alternatively be constructed as a wedge or attached to a wedge, which would be attached to foot plate, foot stretcher or piece of equipment. This applies to all embodiments and variations thereof mentioned in this document.

FIG. IB shows one of many possible forms and orientations which the wedge shape could take. The shape need not have flat upper or outer surfaces, there might be indents, holes, attachment means or multiple shapes oriented in any manner and they might be allowed to swivel. There can be different versions for each foot. As in this instance, the face of the magnet may be parallel with the plane of the wedge, or it may be essentially horizontal, or at any other angle relative to the wedge.

Details of various modifications to the attachment device are shown in later figures.

Figure 1B:
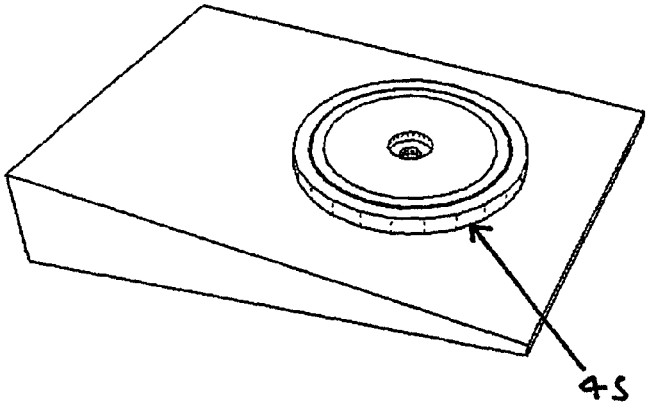
FIG. 1B is a perspective view of an attachment device with a different base plate.
Figure 2:
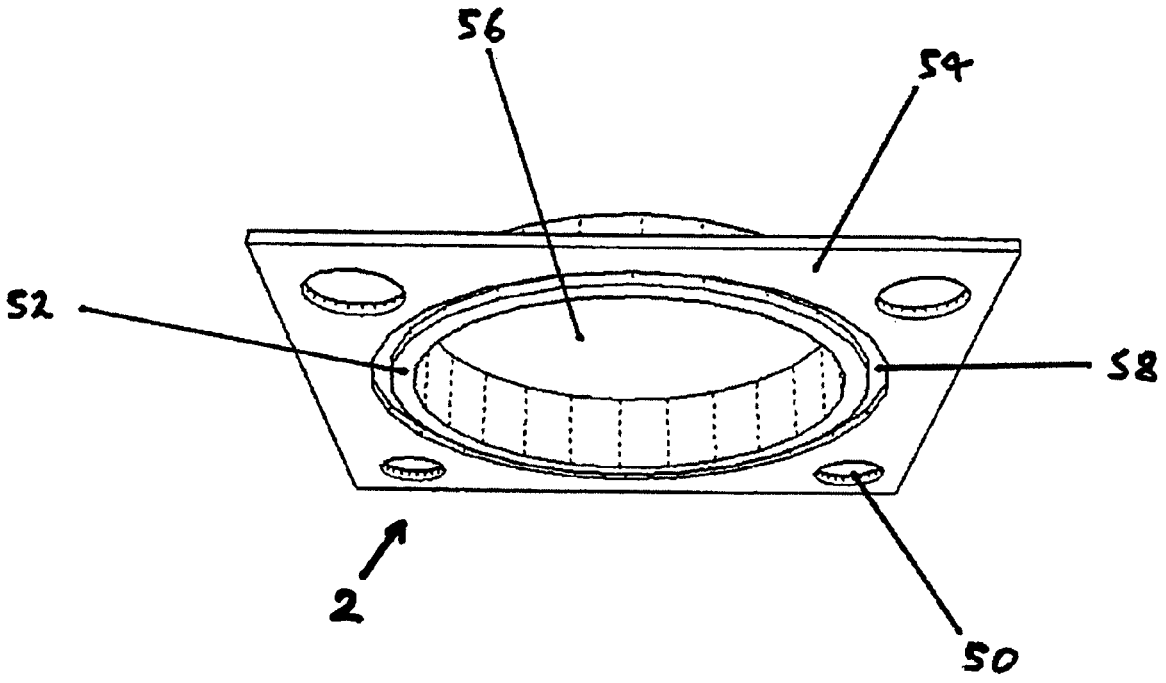
FIG. 2 is a perspective view of an adjustment device.

FIG. 2 is a perspective view of an adjustment device. A non-ferrous cap 52 is designed to fit over magnetic system 45 of FIG. 1. Cap 52 is mounted to, or integrated with an attachment plate 54 of a suitable size and shape. Cap 52 is manufactured in one or more parts using material(s) and method(s) that will allow precise control over the thickness of its base 56, which touches magnet 40 or magnetic system 45. Varying the spacing gap can be used to adapt the holding strength of magnet 40 to attachment device of FIG. 1. Different adjustment devices can be available for different user weight groups. A channel 58 is optionally provided. A hole 50 or multiple holes or attachment methods can be made in attachment plate 54. Cap 52 can have a single wall or multiple walls, optionally with different depths (in relation to base 56), e.g. a stepped terrace could be created. The external wall of cap 52 can be of any shape.

Further adjustment is available e.g. via button 70 described later under FIG. 3. An indent made in the cap to accept the button 70, can change a pivoting function to non-pivoting or by widening the indent, it can enable limited pivoting. By mounting cap 52 or cap attachment plate 54 in a different clockwise or anti-clockwise orientation, the angle at which the shoes are mounted (non-pivot) or the positioning of the arc in the desired pivoting range (limited pivot), can be pre-set according to user requirements.

Not just button 70, but also the other modifications show further means to achieve similar results and might offer further advantages, like quick release.

Other features of cap 52, e.g. proportions of indents in relation to facing protrusions, can be used to facilitate various functions. The adjustment device and or caps 52 can be color coded to designate different features. The features can include left/right, steering/non-steering, pivot/non-pivot, and/or release force values. Various modifications to the adjustment device are shown in later figures.

FIG. 3 illustrates a shoe block assembly 3 in perspective. Recesses 62 and 64 are made in a shoe block 66 to accept adjustment device of FIG. 2.

A ferrous counter plate 68 of suitable size, shape and thickness is located on upper surface of shoe block 66. (From the angle shown, counter plate 68 can be seen through recess 62.) Counter plate 68 can be flat or it can be curved or partially curved and all other parts with which it aligns, and those with which they align, would also be appropriately shaped. Specifically, the facing surfaces of adjustment device FIG. 2 and of attachment device FIG. 1 would be adapted according to the surface of counter plate 68.

Shoe block 66 can be hollow and the term block need not imply that it is manufactured from a solid material. It can be made from a selection of materials to include plastic or carbon fiber. Alternatively, shoe block 66 can be dispensed with completely. In that case, all of the elements of shoe block assembly of FIG. 3, including recesses 62 and 64 would be arranged in the sole of a shoe in the same positions and configuration. Counter plate 68 will be provided in the appropriate place and can be firmly mounted or free to move. Counter plate 68 can be made in two or more parts.

As attachment plate 54 can be of any size or shape, attachment plate recess 64 (or its provision in a shoe) will be adapted to receive attachment plate 54.

An optional button 70 of any shape can be set within recess 62. Cap 52 would be shaped accordingly to accommodate button 70.

Figure 4:
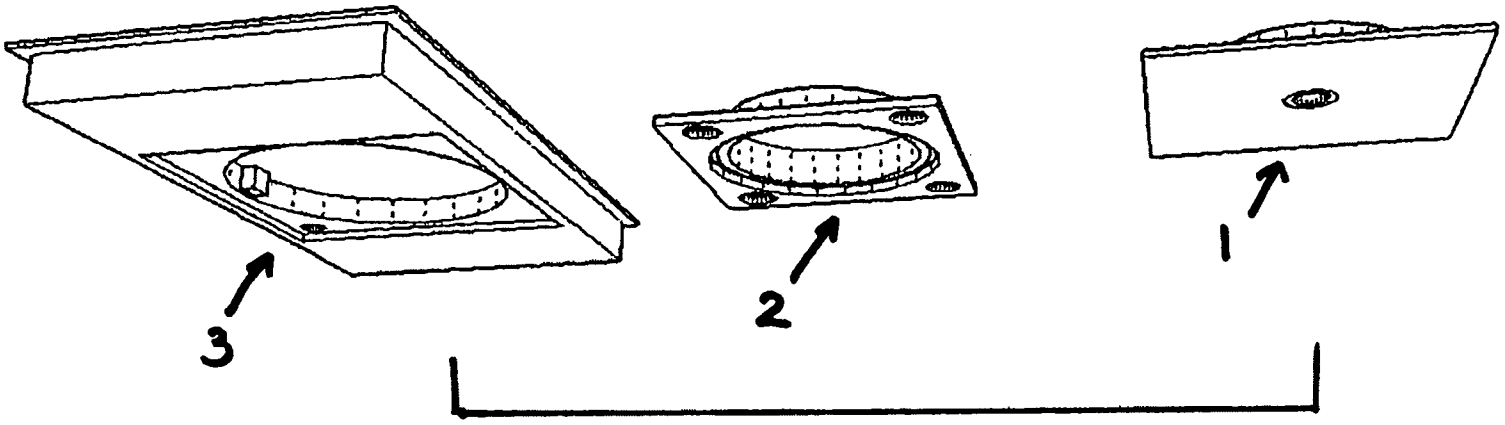
FIG. 4 shows a combined view of the attachment device of FIG. 1, the adjustment device of FIG. 2 and the shoe block assembly of FIG. 3 in accordance with one embodiment.

FIG. 4 shows attachment device of FIG. 1. (right), adjustment device of FIG. 2 (center) and shoe block assembly of FIG. 3 (left). The adjustment device generally fits into shoe block assembly and is fixed thereto with screws or any other attachment means, or could be formed as a part thereof. Shoe block 66 may thereafter be removably attached to the attachment device. Magnet 40 disposed in the attachment device generally attracts ferrous counter plate 68 in the shoe block assembly (or sole of shoe) to removably lock the parts in place. The geometry of magnet 40 and of the adjustment device that interface with each other prevents lateral movement, while allowing the attachment device to rotate in shoe block 66.

Operation

FIGS. 1-4—First Embodiment

The main components for making one embodiment are shown in FIGS. 1, 2, 3 and 4. A foot plate, a foot stretcher and a pair of shoes are not shown, as they are commonly known articles.

In order to use the first embodiment, two attachment devices of FIG. 1 are attached to a foot stretcher on a rowing boat or to any other type of equipment. Alternatively, they can be initially attached to a foot plate, which is then attached to the foot stretcher, or attached directly to the equipment, or integrated with the equipment. It is quite common to use a foot plate to attach shoes to a foot stretcher. A shoe block assembly of FIG. 3 is attached in or to each shoe. Special shoes can be supplied with the shoe block assembly attached or integrated therein, alternatively with the individual elements pre-provisioned, as a unit or otherwise, if there is no shoe block 66.

A user then selects two adjustment devices of FIG. 2 according to their features and his or her personal preferences. One is mounted in each shoe (or shoe block assembly of FIG. 3). Various features are mentioned in the description for FIG. 2. The user can select the appropriate adjustment devices of FIG. 2 in combination with one or more of the optional modifications and mount them accordingly to preset the desired foot splay, enable or disable steering function, change pivoting to non-pivoting and/or adapt the release force required for separation.

The rower gets into the boat in the usual way and pushes off the landing stage. The next step is usually to balance oneself with the oar or oars while reaching over them to put ones feet in the fitted shoes and close the shoe straps. This is a two-handed operation.

When using any embodiment of my attachment system, the rower is already wearing their shoes, as they were put on in the changing room. He or she simply pushes each shoe onto the attachment devices. The coupling is fast and simple. When getting out of the boat, the rower lifts his or her heel to effect the detachment. Depending on the choice of adjustment device of FIG. 2 and the optional modifications installed, a twist or pivoting of the foot might substitute lifting the heel.

The system is designed such that in an emergency, if the boat capsizes, the feet will readily detach from the system by body weight.

Positioning of the foot according to personal choice and the option of being able to pivot or partially pivot or rotate the shoe relative to the equipment add to the user comfort and optimize the ergonomics.

This embodiment might offer a more precise control than other embodiments.

FIGS. 5-9

Optional Modifications for any Embodiment

Figure 5A:
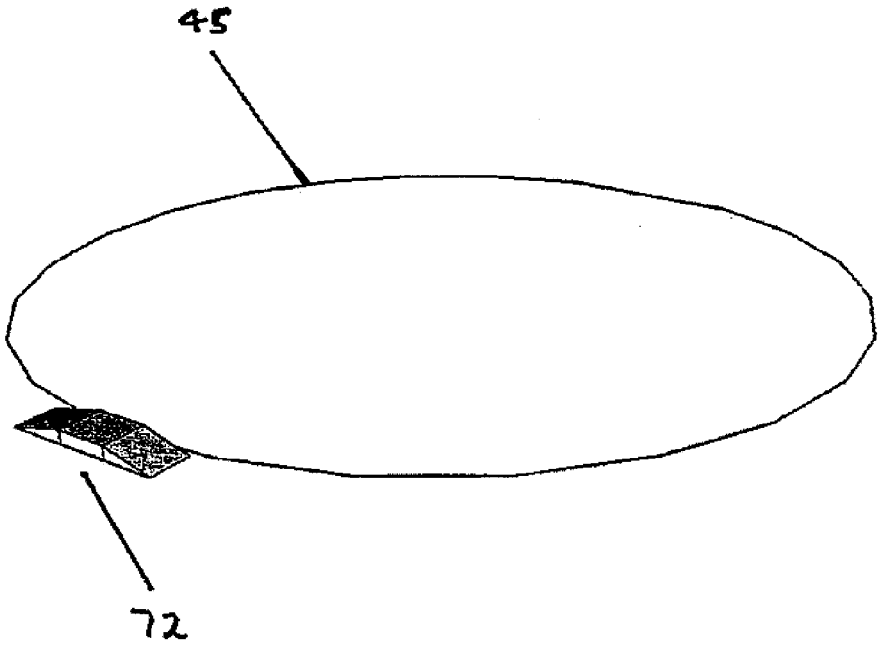
FIG. 5A shows a pyramid mounted close to a magnetic system.

FIG. 5A shows a flat-topped pyramid shape 72 which is mounted singly or in multiples around the periphery of magnetic system 45, shown here as a circle. Pyramid 72 is made of a rigid, preferably non-corrosive material, which can include stainless steel or nylon. Pyramid 72 can take any shape.

FIG. 5B shows one or more magnets 40 set into or below the inclined plane of one or both sides of the pyramid shape 72. The complementary face(s) accepting this pyramid shape 72 could have magnet(s) 40 set into or below their inclined plane(s) in an offset position. The magnet(s) 40 on pyramid 72 could have opposing or attracting magnetic force(s) to those on the complementary shape or a combination of opposing and attracting force(s).

FIG. 5C shows a wedge shape 74 as an alternative to pyramid 72 and can have extension(s) shown on left of lower wedge 74, suggesting a block shape. One or more magnet(s) 40 can be set into or below the inclined plane of one or both sides of wedge 74 or the extension area(s). Magnets 40 can be rare earth or can be of lower strength. When wedge 74 or another suitable shape with an inclined plane is placed against a second complimentary shape, both shapes can move against each other and cause the surfaces to which they are mounted to move away from each other. There might be a ridge or similar restraint on base plate 48, so that when both wedges 74 are placed together, the upper wedge 74 cannot more laterally away from the lower wedge 74, but only towards it by riding up the inclined plane of the opposing wedge 74. Instead of wedges 74, block shapes could be used.

FIG. 5D. Cross-section. Two wedges 74 shown in FIG. 5C (or any other shapes) can optionally be coupled to each other. This might be accomplished with, e.g., a pin 78 and guide channel 76, a dovetail-style connection or other suitable connector or multiples thereof.

A design using pin 78 and guide channel 76 can be incorporated in each of the opposing surfaces of wedge 74. Correctly dimensioned, this will enable wedges 40 to slide against each other in contact but also enable them to separate up to a pre-set distance, while still remaining coupled.

Alternatively or additionally, a guide channel 76*b* and slide 77 construction can be used on the outside edges of wedges 74 (or other shapes).

Two wedges 74 might alternatively or additionally be structurally interlinked to enable a sliding movement, but to prevent total separation from each other.

Figure 6:
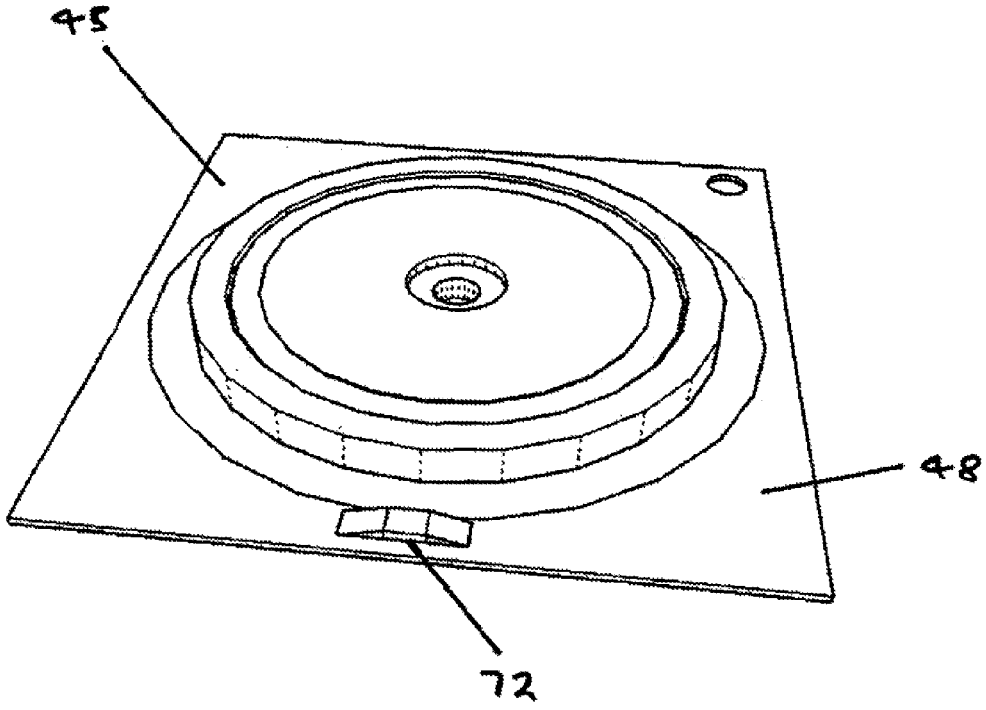
FIG. 6 shows a pyramid mounted onto the attachment device.

If wedges 74 are not interconnected, then first wedge 74 might be attached in a similar position to pyramid 72 shown in FIG. 6, but it could be attached elsewhere. An opposing wedge 74 might be attached on shoe block assembly FIG. 3 or within sole of shoe. Alternatively a provision might be made for opposing wedge 74 in adjustment device of FIG. 2.

If wedges 74 are interconnected, then a provision can be allowed for on adjustment device of FIG. 2, on, or in shoe block assembly FIG. 3, or within sole of shoe. Additionally, a shell (not shown) attached to shoe block assembly of FIG. 3 or within sole of shoe, may be provided to fit over, or be integrated in upper wedge 74 and assist in controlled movement. A simple arrestment means can prevent slippage between shell (not shown) and wedge 74.

FIGS. 5A-5D Pyramids 72 and/or wedges 74 might be placed anywhere and need not be in proximity to attachment device of FIG. 1.

FIG. 6 shows Pyramid 72 on base plate 48 in proximity to magnetic system 45. Pyramid 72 can touch or can alternatively be mounted to, or be manufactured as part of magnetic system 45 or base plate 48. Pyramid 72 can take any shape and can be located in any area of base plate 48, the foot plate, the foot stretcher or the piece of equipment.

Figure 7:
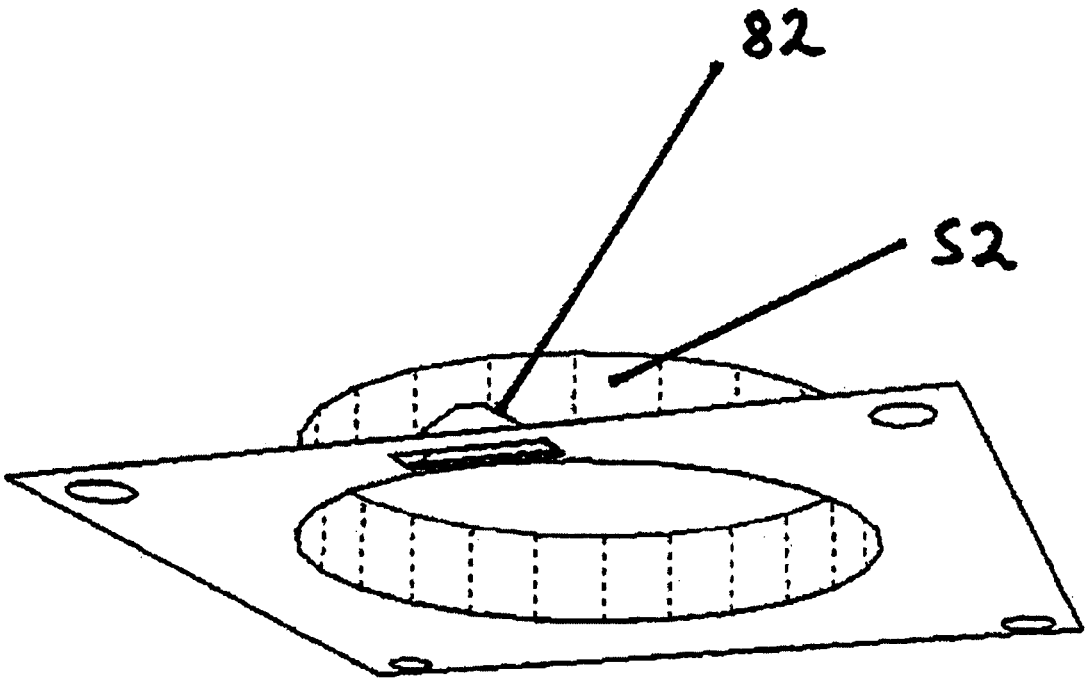
FIG. 7 shows a receptacle for the pyramid combined with the adjustment device.

FIG. 7 shows adjustment device of FIG. 2 with an integrated receptacle 82 to receive pyramid 72 or other shape. Receptacle 82 can be arranged singularly or in multiples, touching or in proximity to cap 52. Receptacle(s) 82 can be created in different shapes and sizes and might alternatively be placed within, or formed integrally in shoe block assembly of FIG. 3 or sole of shoe.

Figure 8:
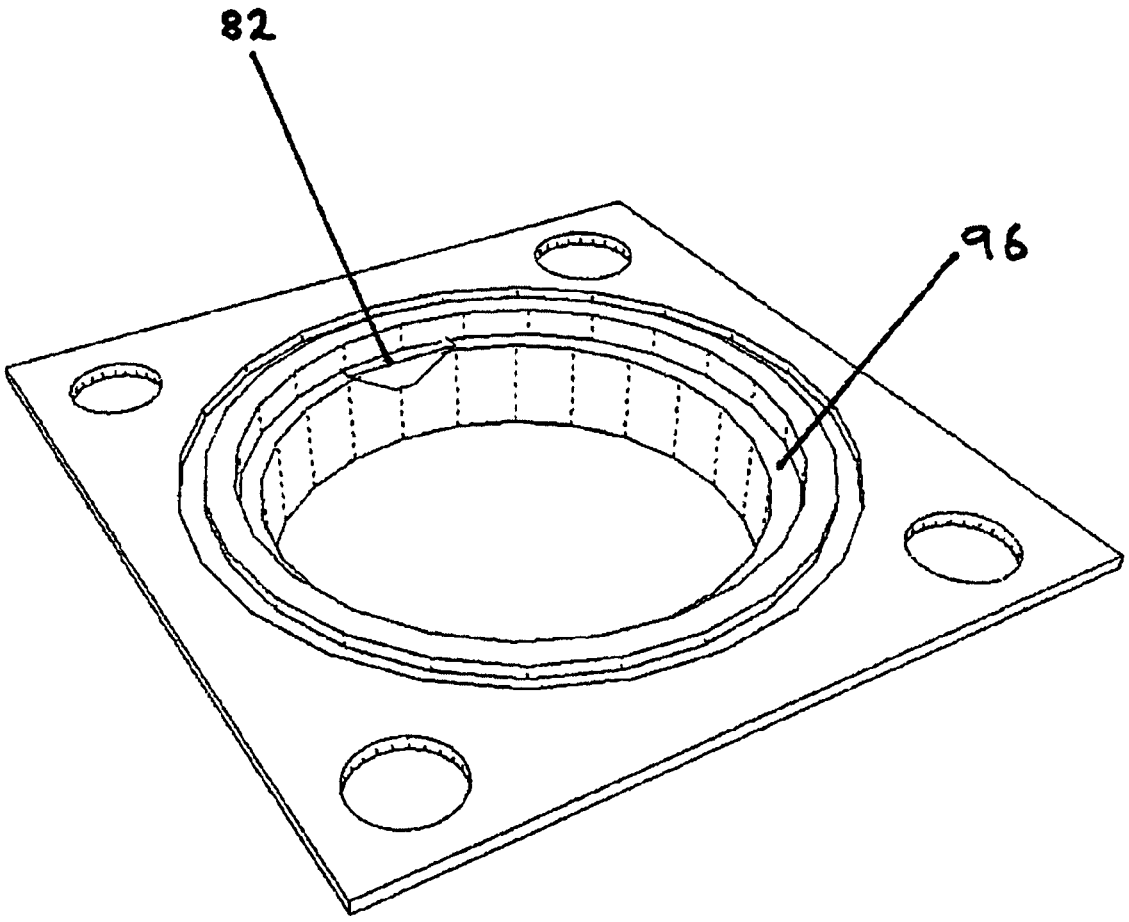
FIG. 8 shows a receptacle for the pyramid integrated in the wall of the cap.

FIG. 8 shows receptacle 82 for receiving pyramid 72, in this instance set within one of the cap walls 96 of the adjustment device. There can be more than one receptacle 82 and they can be of different shapes to accept correspondingly shaped wedges 74. Receptacle 82 can alternatively be elongated to allow for limited rotational movement of the recipient part.

Figure 9:
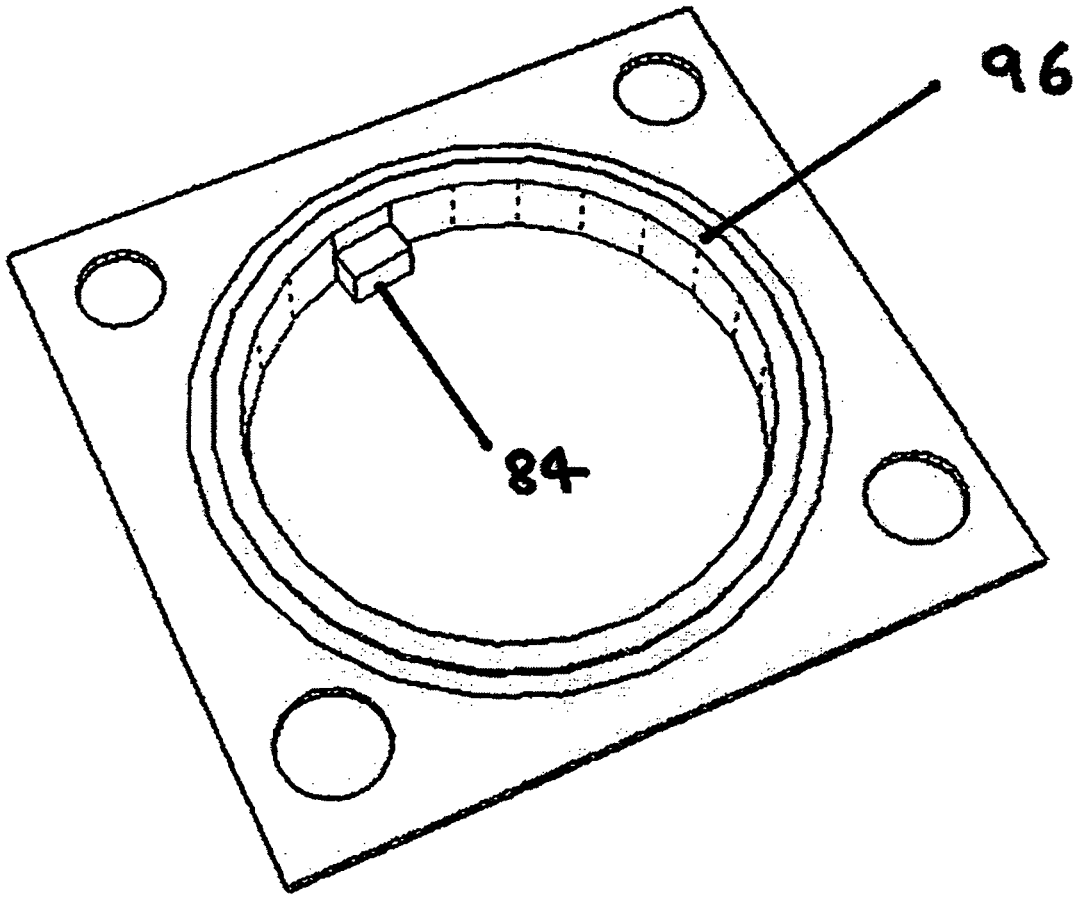
FIG. 9 shows a button integrated in the wall of the cap.

FIG. 9 shows a cap button 84 integrated in or on one of the cap walls 96 of the adjustment device. Cap button(s) 84 can be of any shape or quantity. An indent or indents to accept the protrusion(s) would be made in magnetic system 45 or any part that takes its place. In this instance, cap button 84 limits rotation of the attachment device within the adjustment device. Partial limits may be imposed with a longer indent in the attachment device as compared to the width of cap button 84. Cap button(s) 84 may also have a shape that locks the adjustment device to the attachment device. For example, cap button(s) 84 may have an upside down L shape that engages with an L shaped aperture in the adjustment device with a rotation of shoe block 66.

Operation

FIGS. 5-9—Optional Modifications for any Embodiment

Rowers of competition boats currently cannot pivot their feet because the shoes are permanently fixed. An exception is found in some boats without a coxswain, where one foot of the person who is steering can pivot in order to control the rudder.

Rowers of recreational sport rowing boats and users of rowing machines and cycling machines likewise cannot pivot their feet.

FIGS. 1-4 show an embodiment that basically permits a pivoting function. The various modifications in FIGS. 5-9 show different ways to cater for swivel and non-swivel preferences or needs.

By combining pyramid 72 and receptacle 82 shown in FIGS. 5-9 it is possible to change the embodiment shown in FIGS. 1-4 from pivoting to non-pivoting. Two opposing wedges 74 (FIG. 5C) could serve a similar function. In either case, the combination will also allow easy separation of magnetic system 45 from counter plate 68 by twisting the foot, which causes the pyramid shaped 72 or wedged shaped 74 components to lift ferrous counter plate 68 away from magnet 40 or magnetic system 45. Depending on the sizing and placement of e.g. pyramid 72 and/or wedge 74 and their counterparts, a partial pivoting can naturally be accomplished.

FIG. 9 likewise presents an alternative way to change a pivoting system to non-pivoting or partially pivoting.

The use of these optional modifications is clear from the detailed description.

FIGS. 10-11

Optional Modifications for any Embodiment

Figure 10:
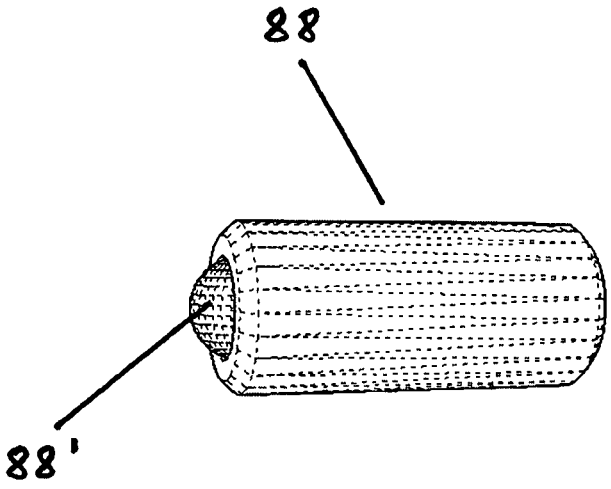
FIG. 10 illustrates a spring plunger.

FIG. 10 shows a spring plunger 88 preferably made of corrosion-resistant material, having a spring loaded ball 88' at one end, alternatively a solid drive plunger, i.e. not spring loaded, can be used.

Figure 11:
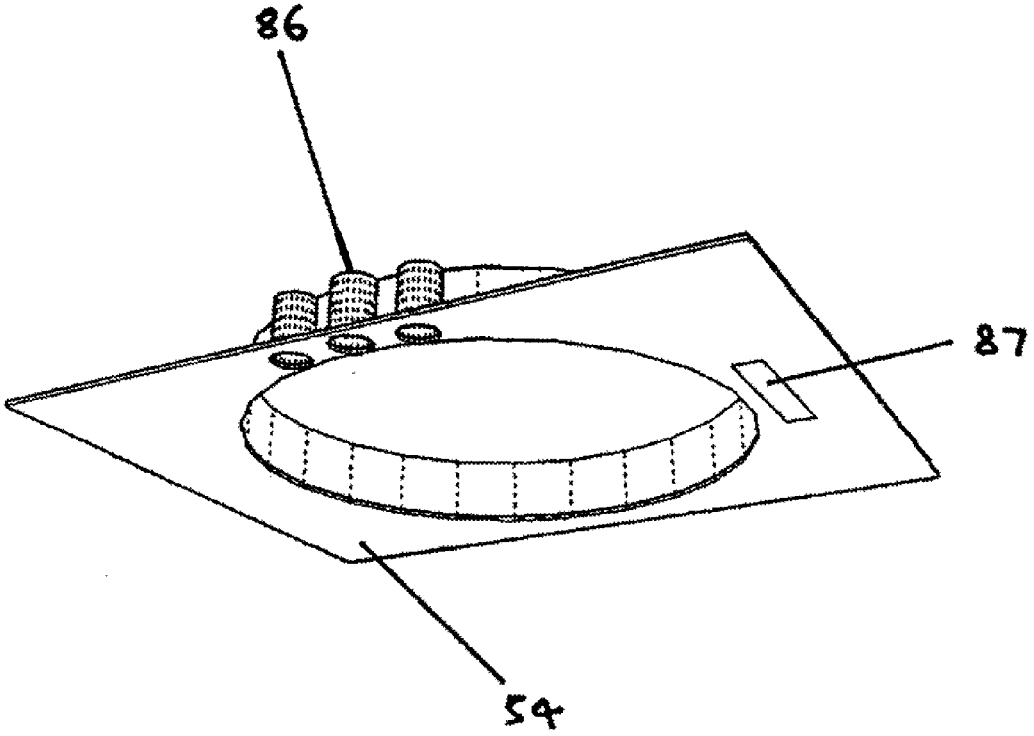
FIG. 11 shows the adjustment device with a mounting arrangement for spring plungers.

FIG. 11 shows three hollow cylinders (more can be used) forming a mounting arrangement 86 set within or alongside the adjustment device of FIG. 2 and constructed to accept spring plungers 88 (not shown) set inside the cylinders.

Alternatively, the location of the parts can be reversed. Spring plungers 88 can be mounted in base plate 48 or the foot stretcher, and appropriate orifices can replace mounting arrangement 86.

Alternatively or additionally, a slot 87 or void, perhaps arc shaped, can be made within attachment plate 54 to receive spring plungers 88 or another form, e.g. a tab or lip (not shown) emanating from base plate 48, the foot plate or the foot stretcher.

Operation

FIGS. 10-11—Optional Modifications of any Embodiment

FIGS. 10 and 11. Spring plunger 88, mounting arrangement 86, and/or slot 87 provide a way of adapting a pivoting system to non-pivoting and might have spring plungers 88 with different spring strengths, i.e. releasing capability. Spring plungers 88 could also be arranged to provide pivoting or limited pivoting between attachment device of FIG. 1 and adjustment device of FIG. 2. When the ball(s) of spring plunger(s) 88 align with similarly sized orifice(s), then pivoting is disabled. If the number of orifices exceeds the number of spring plunger(s) 88, different alignment positions of the shoe can be selected. Five orifices and three spring plungers 88 would e.g. allow three different alignment positions. Spring plunger(s) 88 used in combination with slot 87 could be used to enable limited pivoting.

FIGS. 12-16

Alternative Embodiments

Figure 12:
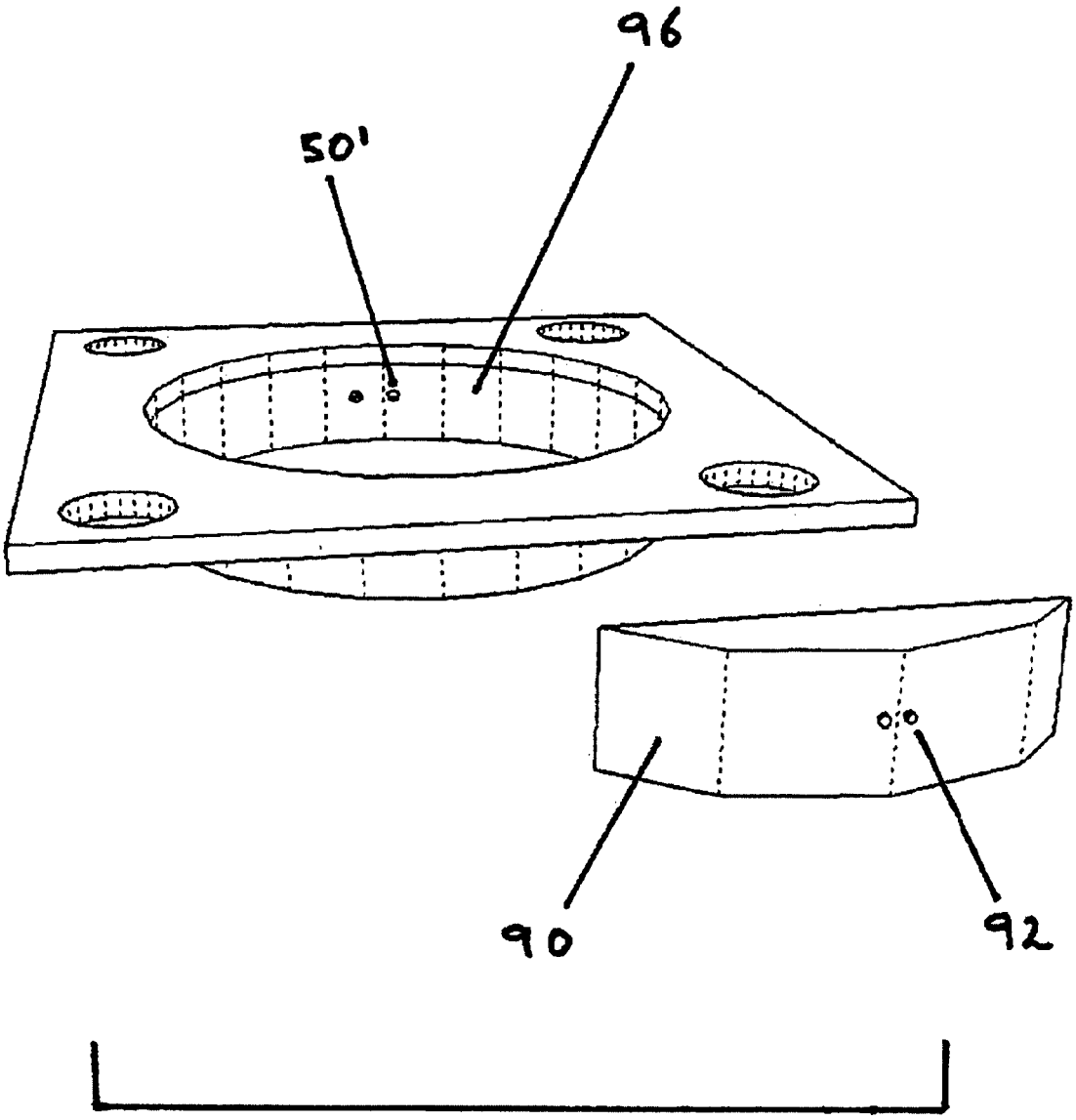
FIG. 12 shows in perspective the adjustment device of FIG. 2 with a restraining segment.

FIG. 12 shows in perspective a restraining segment 90 for insertion into adjustment device of FIG. 2 and affixed possibly with lugs 92 and holes 50' in the cap wall 96. The recess thus forms the shape of a truncated cylinder.

Alternatively, the entire cap wall 96 can be constructed to accept a truncated cylinder shape or another shape serving the same function.

The flat side of restraining segment 90 can extend the whole depth of the recess or just part thereof.

Figure 13:
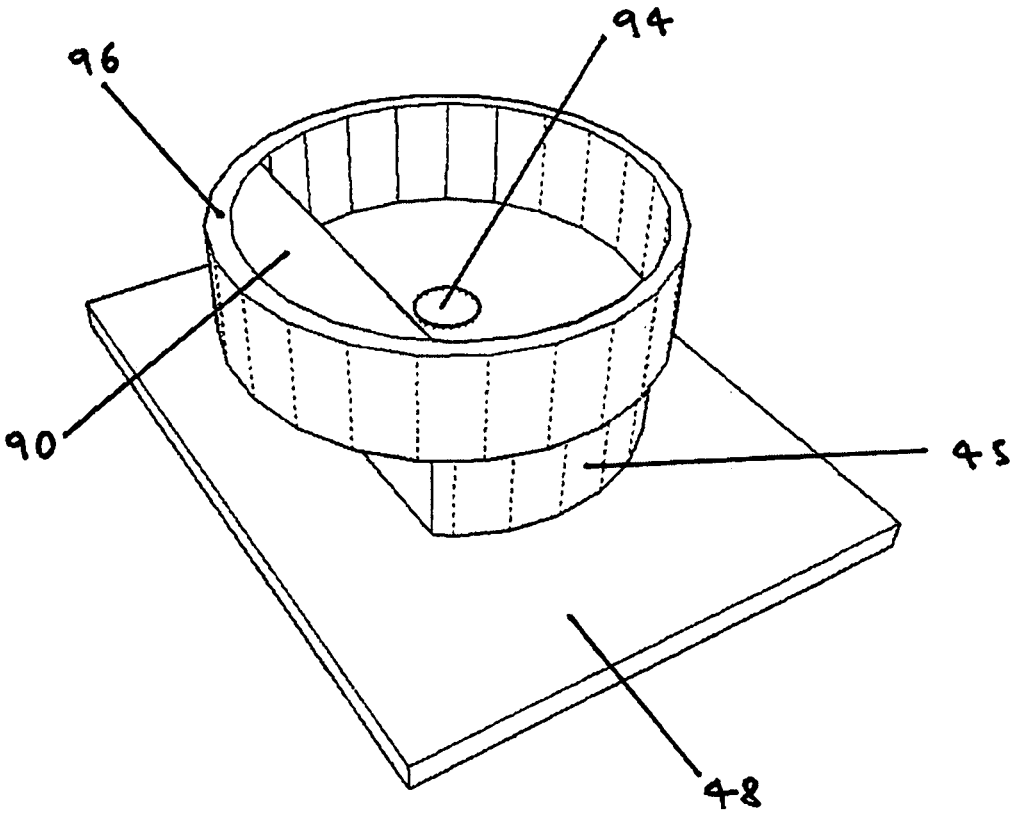
FIG. 13 shows a dissected view of an adjustment device similar to FIG. 2 touching an attachment device similar to FIG. 1.

FIG. 13 is a dissected illustration showing modified adjustment device of FIG. 2 and a modified attachment device of FIG. 1. Cap base 56 and attachment plate 54 (both of which from this angle would be closest to the eye) have been removed for clarity.

This view shows cap wall 96 now containing restraining segment 90 from FIG. 12. They are being pushed over a modified version of attachment device (FIG. 1). Magnetic system 45 has been modified into a truncated cylinder shape. The individual parts of magnetic system 45 (detailed in FIG. 1) have all been adapted for the modified shape.

Alternatively, the wall of metal pot 42 of magnetic system 45 can be made thicker and flattened on one side to create the truncated cylinder shape as shown. Then either the other parts of magnetic system 45 would be downsized accordingly or all the parts of adjustment device of FIG. 2 and shoe block assembly of FIG. 3 would be made larger.

Note: For simplicity, the number 45 is used for any magnetic system of whatever shape and size throughout this document.

In this embodiment, magnetic system 45 is optionally pivotally attached 94 to base plate 48. When cap 52 as part of adjustment device of FIG. 2 is inserted in the shoe and the foot pivots, so does magnetic system 45.

Figure 14:
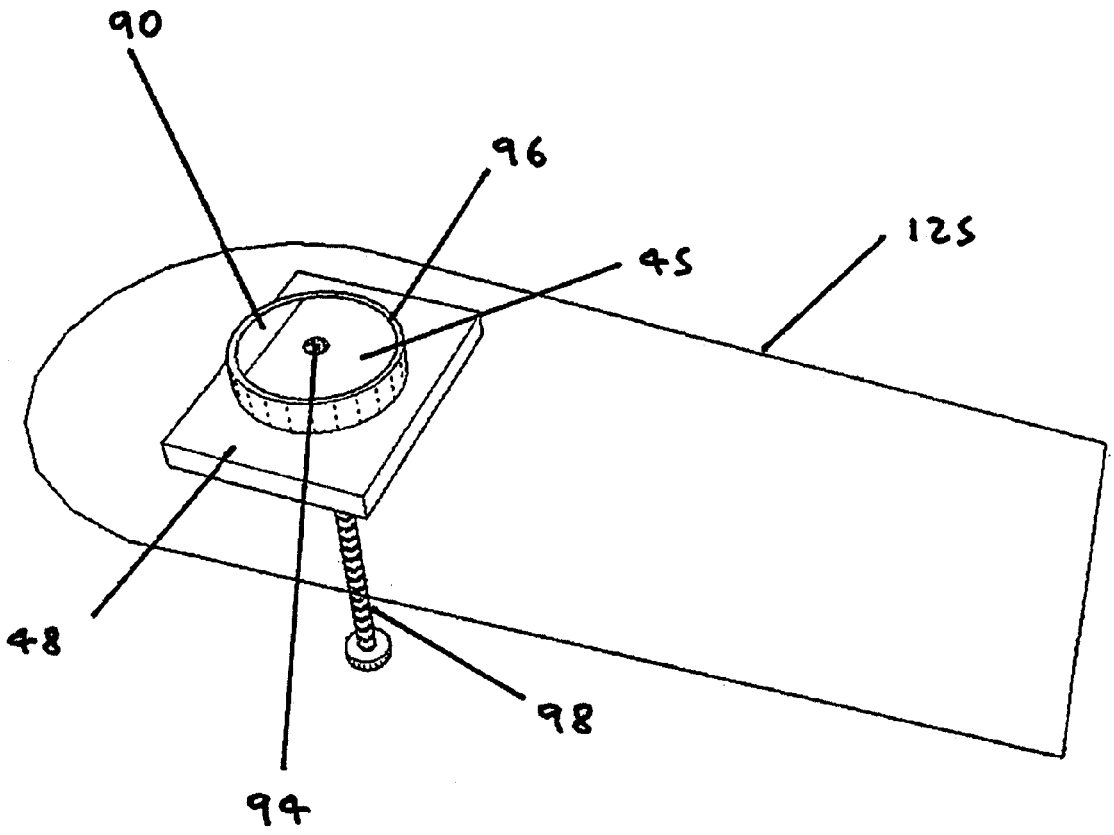
FIG. 14 shows a steering mechanism attached to devices shown in FIG. 13.

FIG. 14 is a perspective, dissected view and a continuation from FIG. 13. Cap wall 96 containing restraining segment 90 is shown now pushed over the modified magnetic system 45. Cap base 56 and attachment plate 54 (both of which from this angle would be closest to the eye) have again been removed for clarity.

The outline of a shoe sole 125 (not to scale) is shown for illustrative purposes.

Magnetic system 45 has an attached spindle 98 which protrudes below the surface of base plate 48. Base plate 48 is mounted onto the foot stretcher (not shown). Alternatively, base plate 48 is mounted on a foot plate (not shown) which is mounted on the foot stretcher. An orifice (if needed) in the foot stretcher accommodates spindle 98.

Magnetic system 45 is non-pivotally or pivotally mounted 94 to base plate 48 in this arrangement.

Figure 15:
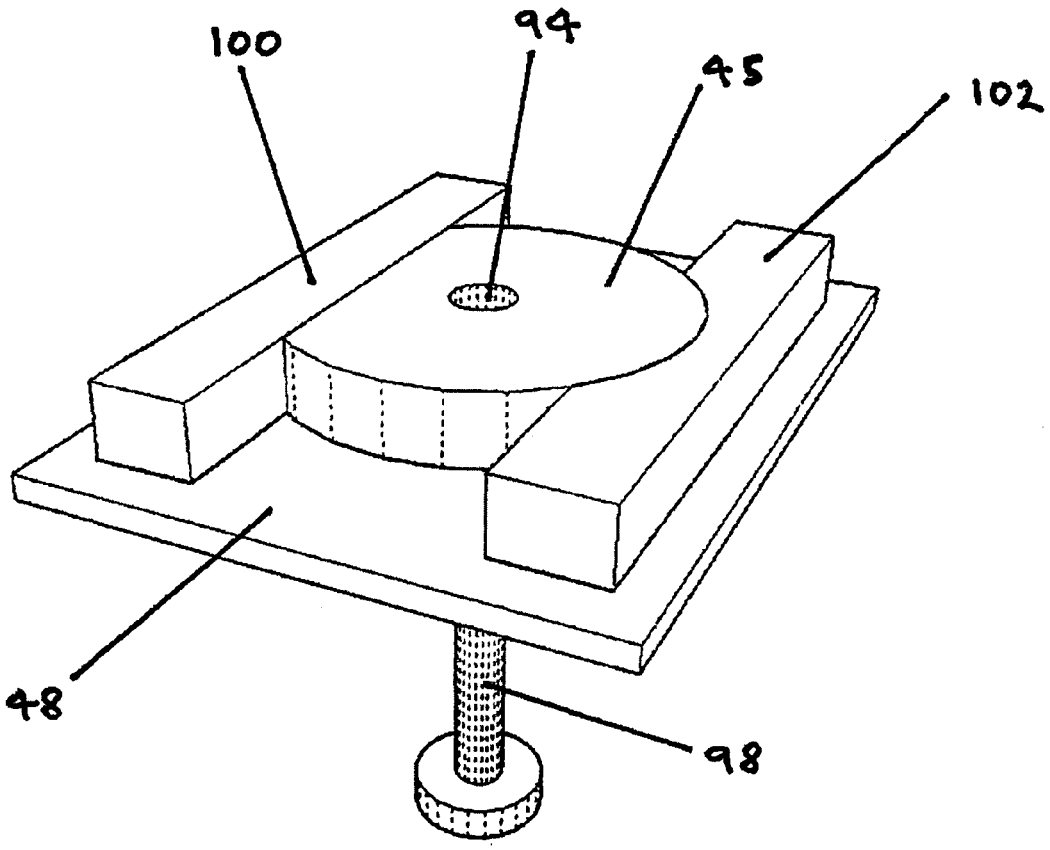
FIG. 15 shows a partially dissected view of a modified embodiment and with an optional steering mechanism.

FIG. 15 is a dissected drawing. The entire cap 52 and attachment plate 54 (both of which from this angle would be closest to the eye) have been removed for more clarity.

This embodiment calls for a modified cap 52 to fit modified magnetic system 45, shown here in the form of a truncated cylinder. The use of cap 52 is optional and if not used, recess 62 in shoe block assembly of FIG. 3 would be resized to suit.

Modified magnetic system 45 is pivotally mounted 94 to base plate 48. To avoid ongoing repetition, base plate 48 is mounted to foot plate, foot stretcher or item of equipment as previously described.

A steering block 100 shown on the left is mounted in shoe block assembly of FIG. 3 and aligns with the flat side of magnetic system 45 and cap 52 (if used) which covers magnetic system 45.

The alignment block 102 shown on the right can be alternatively mounted on base plate 48 or on shoe block 66.

In another embodiment, none of the parts in this Figure is moveable and no steering function is incorporated. From the selection of block 100, alignment block 102, and magnetic system 45, one part is mounted in or on shoe block 66, alternatively in or on sole of shoe 125. The other two parts are mounted on base plate 48, foot plate (not shown), foot stretcher (not shown), or item of equipment (not shown).

Figure 16:
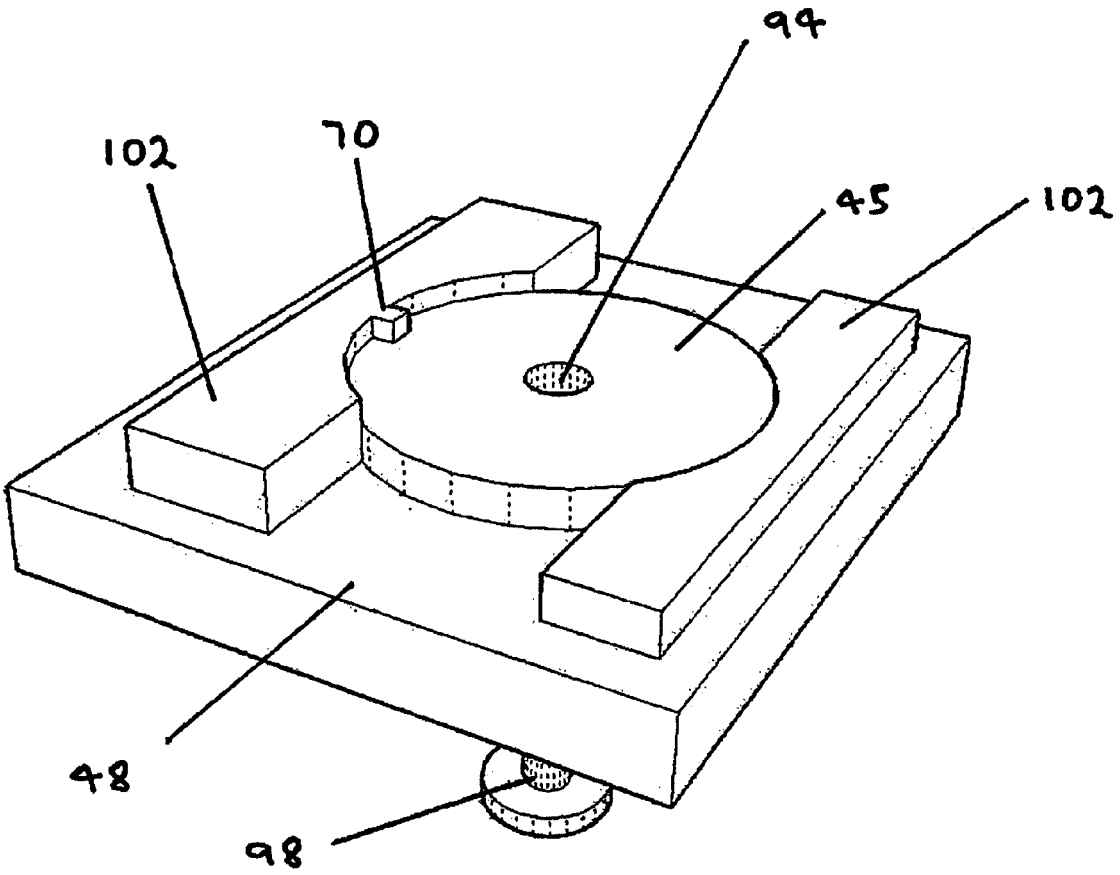
FIG. 16 shows a similar assembly with an alternative steering function.

FIG. 16 is a dissected drawing. The entire cap 52 and attachment plate 54 (both of which from this angle would be closest to the eye) have been removed for more clarity. The use of cap 52 is optional and recess 62 would be resized to suit if it is not used.

FIG. 16 is similar to FIG. 15, but in this embodiment magnetic system 45 is cylindrical and in which optionally an indentation can be made. This aligns with a protrusion or button 70, integral with or mounted on alignment block 102, shown on the left-hand side. Multiple indentations and/or protrusions are possible. Alignment blocks 102 can optionally have concave or partially concave surfaces.

Alignment block 102 on left is shown higher than magnetic system 45, but other heights are possible.

Magnetic system 45 is pivotally mounted 94 to base plate 48. To avoid repetition, base plate 48 is mounted to foot plate, foot stretcher or item of equipment as previously described.

Button 70 can take the form of a pin, a wedge or other shape to accomplish the same result.

Alignment blocks 102 can both be mounted on base plate 48 or on shoe block assembly of FIG. 3 or one on each. If no shoe block assembly is used, then a location inside sole of shoe 125 can be selected.

Operation

FIGS. 12-16—Alternative Embodiments

FIGS. 12-14 illustrate how the steering function can be enabled by incorporating a restraining segment 90 of FIG. 12 or a similar element. When the foot pivots, so does magnetic system 45 and spindle 98 to which the steering wires (not shown) are connected. The steering wires lead to the rudder of the boat (not shown).

Alternatively, magnetic system 45 can be non-pivotally mounted, thus preventing a pivoting action of the foot.

Therefore, various ways are shown to adapt standardized embodiments to enable or disable a pivoting function according to need or personal preference.

FIGS. 15 and 16. When either steering block 100 or alignment block 102 is mounted in shoe block assembly of FIG. 3, they both serve the same function, i.e. when the foot pivots, spindle 98 moves, thus steering the boat via wires which are attached to the rudder.

FIGS. 17-19

Alternative Embodiments

Figure 17:
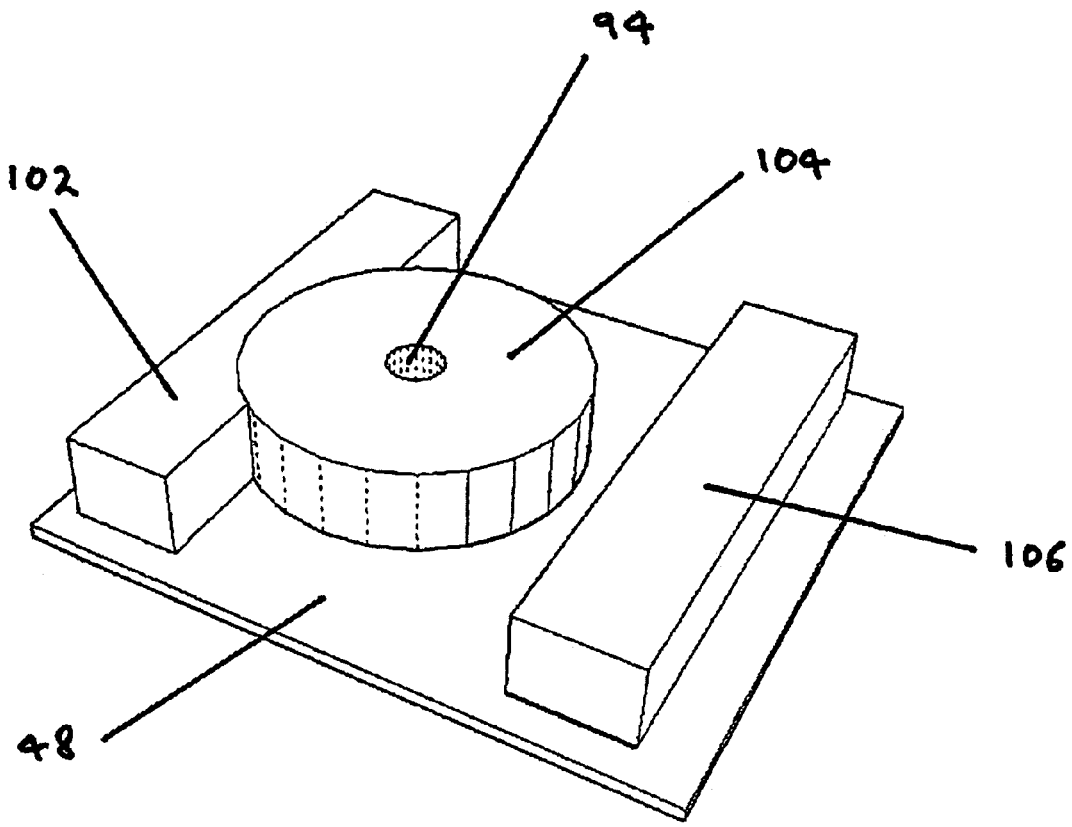
FIG. 17 shows a partial, dissected view of an assembly with a pivotal function in accordance with another embodiment.

FIG. 17 shows a cylindrical form 104 which can be magnetic and is mounted by pivotal attachment 94 on base plate 48. Alignment block 102 with an optional concave or partly concave surface and optionally magnetic, is mounted on shoe block assembly of FIG. 3 (not shown). Alternatively, alignment block 102 is an integral part of shoe block assembly of FIG. 3 or mounted in a recess thereof.

An optional stopper block 106 which can be of a different shape and possibly magnetic or a magnetic system 45 is mounted on base plate 48 or shoe block assembly of FIG. 3 (not shown).

If any from the list of cylindrical form 104, alignment block 102, or stopper block 106 are magnetic, then counter plate 68 in shoe block assembly of FIG. 3 (not shown) is suitably sized to function appropriately. Any from this list of parts can also be provided with different magnetic strengths which need not be rare-earth magnets.

Blocks 102 or 106 can alternatively be magnetic with the magnetic attraction directed towards base plate 48. In this case, ferrous counter plate 68 can be mounted on base plate 48. Base plate 48 optionally has a low friction surface.

Alternatively, cylindrical form 104 can be pivotally or non-pivotally mounted on shoe block assembly of FIG. 3, optionally in or on shoe sole 125 (not shown).

Figure 18:
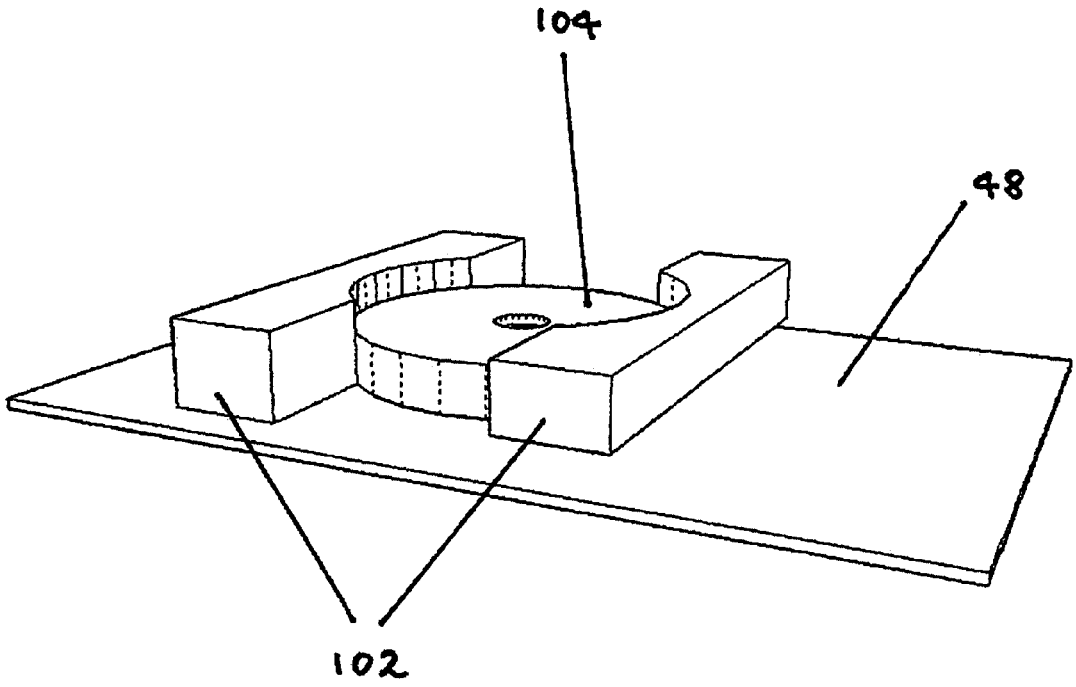
FIG. 18 shows a partial, dissected view of a similar assembly with a pivotal function.

FIG. 18. Cylindrical form 104, which can be magnetic, is non-pivotally mounted on an item of sports equipment (not shown) or base plate 48. Cap 52 is optional (not shown.) Two alignment blocks 102 with optionally concave or partly concave surfaces are mounted in shoe block assembly of FIG. 3 (not shown), shoe sole 125 (not shown) or one in (or on) each. Blocks 102 mate with cylindrical form 104 when the shoe and base plate 48 are brought together. Base plate 48 can have a low friction surface.

Alignment blocks 102 are shown higher than cylindrical form 104, but other heights are possible.

Ferrous counter plate 68 can optionally be mounted on shoe block assembly of FIG. 3 if magnets are used.

Option not illustrated. A button 70 shown in FIG. 16 or a single or multiple pin(s) can be optionally accommodated in block(s) 102 or cylindrical form 104. Hole(s) 50' or indent(s) can optionally be made on the interfacing element(s) to accept button(s) 70 or pin(s) if desired.

Figure 19:
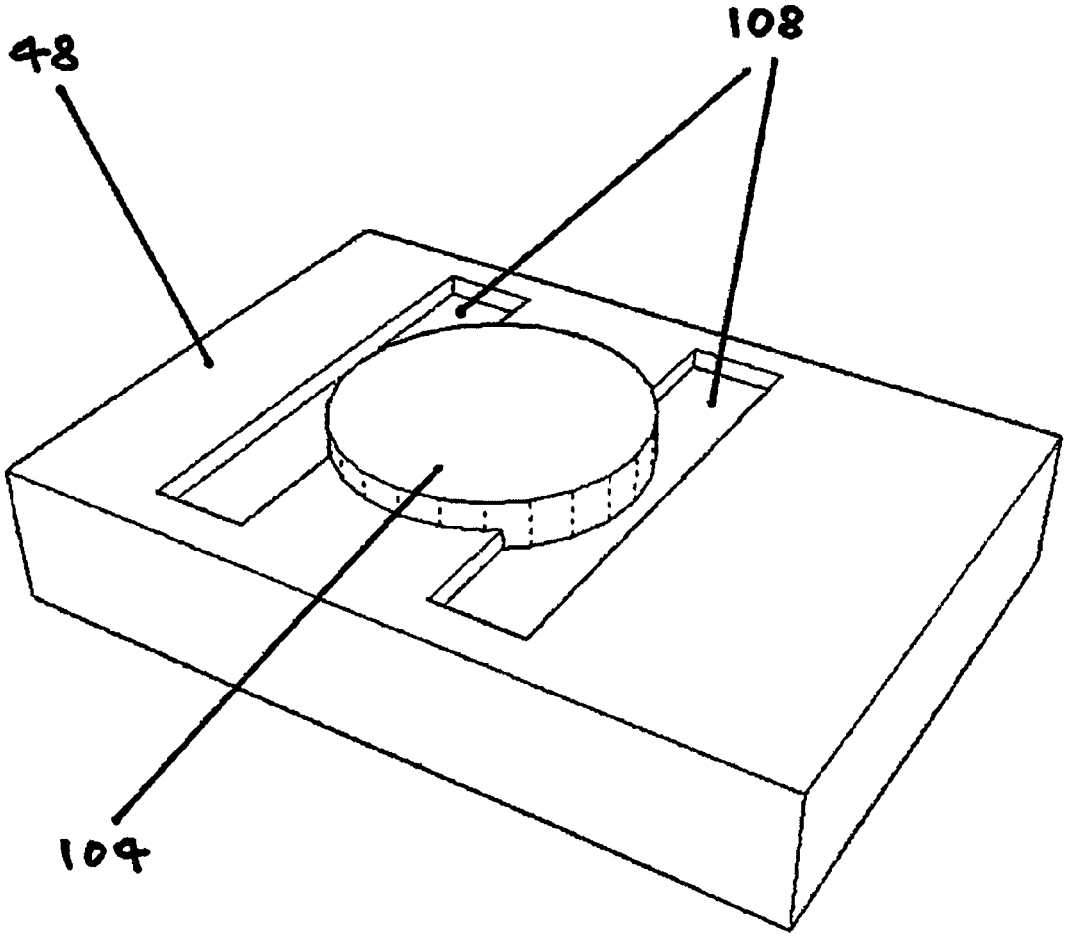
FIG. 19 shows a partial, dissected view of another similar assembly with a non-pivotal function.

FIG. 19 shows a block illustrating the sports equipment or base plate 48 with two alignment hollows 108 for accepting two alignment blocks 102 (FIG. 18) mounted on shoe block assembly of FIG. 3. One or more alignment hollow(s) 108 will be provided and sized according to alignment block(s) 102.

Cylindrical form 104 which can be a magnet 40 or a magnetic system 45 is mounted in or on the sports equipment, foot stretcher, foot plate or base plate 48.

Operation

FIGS. 17-19—Alternative Embodiments

These alternative embodiments show further ways to enable or disable a swivel function according to need or personal preference.

FIG. 17 illustrates that the shoe can pivot about the axis of cylindrical form 104.

(As in the first embodiment, when using magnets, counter plate 68 would be mounted in shoe block assembly of FIG. 3). By twisting the shoe far enough left or right (clockwise or counterclockwise), counter plate 68 will be moved away from stopper block 106, which will remove or reduce the magnetic force from stopper block 106 (if magnetic). This will ease separation of the shoe from the item of equipment.

The embodiment in FIG. 18 offers a pivoting connection and a twisting of the shoe will move alignment blocks 102 across the surface of base plate 48.

The optional button(s) 70 or pin(s) can be used to disable pivoting.

The features from FIG. 18 combined with FIG. 19 will create a non-pivoting connection.

FIG. 20

Alternative Embodiment

Figure 20:
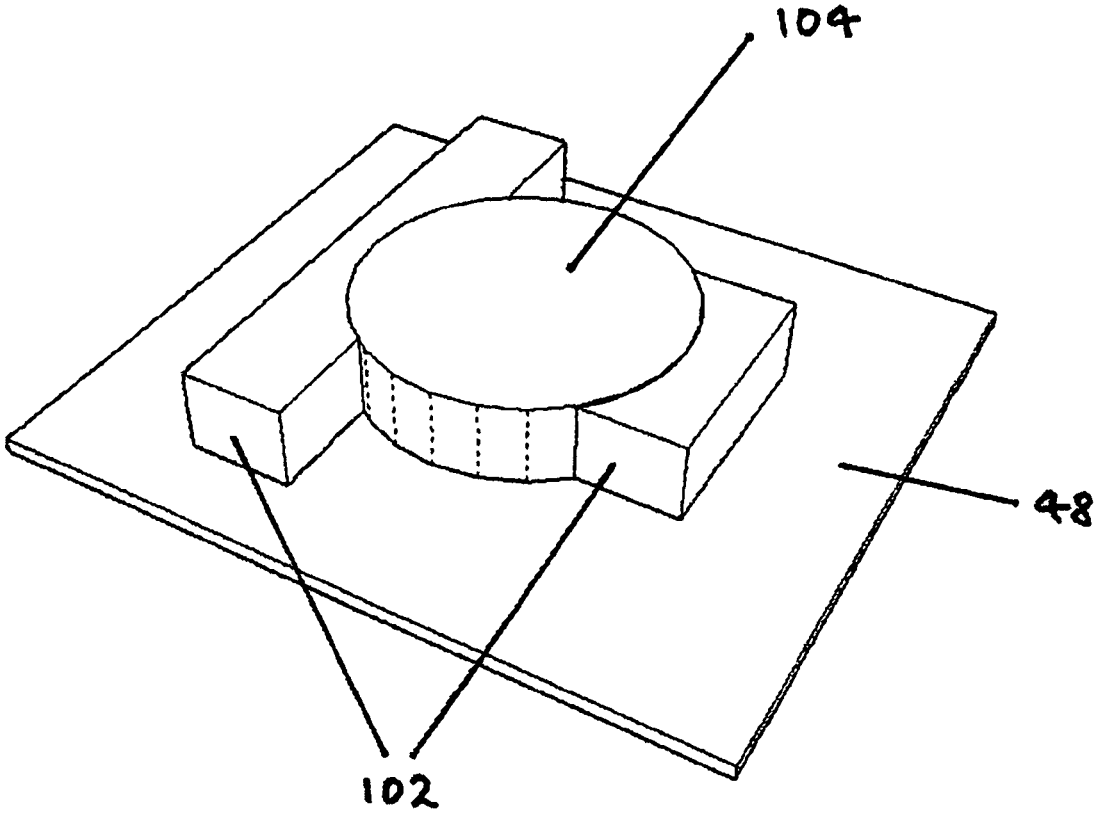
FIG. 20 shows a non-pivoting cylindrical form with on shoe mounting in accordance with another embodiment.

FIG. 20 shows cylindrical form 104 and two alignment blocks 102 optionally with concave or partly concave surfaces. Concave surfaces can optionally extend the whole length of block 102 as shown on block 102 at the right. The size and/or proportions of blocks 102 in relation to cylindrical form 104 can be constructed as desired. Cylindrical form 104 is mounted non-pivotally in or on shoe sole 125 (not shown). Alignment blocks 102 are mounted on an item of sports equipment (not shown), foot stretcher (not shown), foot plate (not shown) or base plate 48. Alternatively, two alignment blocks 102 can be engineered together with base plate 48 from one piece of material, which can be e.g. corrosion-resistant steel.

The use of adjustment device FIG. 2 and shoe block assembly of FIG. 3 is optional with this embodiment. If they are not used, a suitable chamber (not shown) will be provided in the shoe to accept alignment blocks 102 and cylindrical form 104. This chamber can be the exact shape and size of blocks 102 and cylindrical form 104 or any other shape and size. If adjustment device FIG. 2 and shoe block assembly of FIG. 3 are not used, but a magnet 40 or magnetic system 45 is used, then a suitably located ferrous counter plate 68 can be provided.

Option (not illustrated) as discussed regarding FIG. 18. A button 70 shown in FIG. 16 or multiple buttons or a single or multiple pin(s) can optionally be accommodated in alignment block(s) 102 or cylindrical form 104. Hole(s) 50' or void(s) can optionally be provided on the adjacent element(s) to accept button(s) 70 or pin(s) if desired.

Base plate 48 is mounted to foot plate, foot stretcher or item of equipment as previously described.

Optionally, spindle 98 (FIG. 14) can be attached to base plate 48 and/or cylindrical form 104 from below. In this case, a hole 50' would be provided in base plate 48. If cylindrical form 104 is not attached to base plate 48, it might have a simple engagement mechanism like e.g. a Phillips screw slot in its base to releasably couple it to a Phillips screw head on spindle 98, which protrudes through above mentioned hole 50'. Base plate 48 can optionally be pivotally mounted to foot stretcher or foot plate.

One or more of the optional modifications shown in FIGS. 21-24 are recommended for use with this embodiment.

FIGS. 21-24

Further Optional Modifications

Figure 21A:
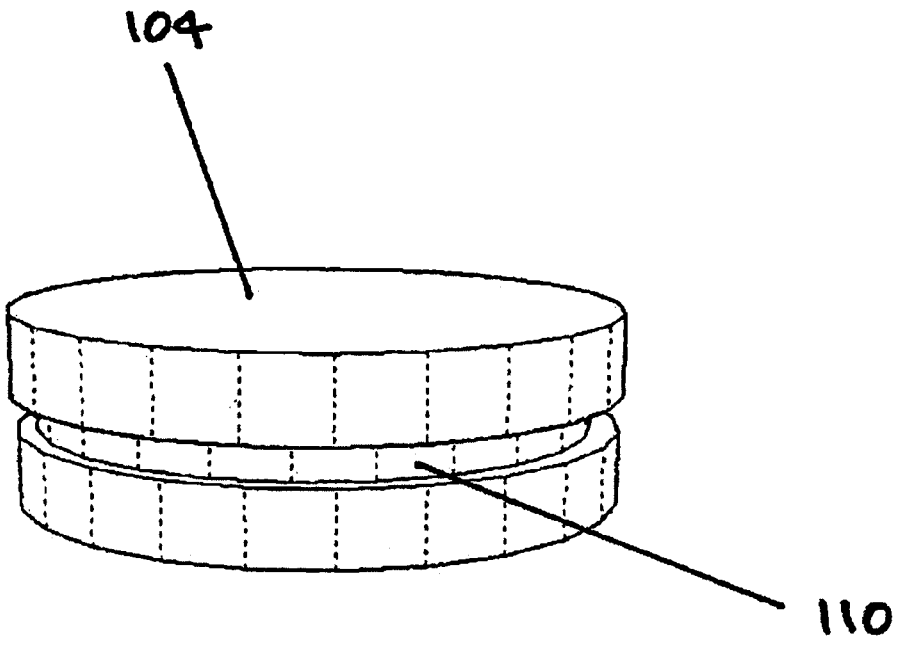
FIG. 21A shows a modification for the cylindrical form.

FIG. 21A illustrates one possible embodiment of cylindrical form 104 with one or more circumferential grooves 110.

Cylindrical form 104 can be made of metal, which can be magnetic or it can be a magnetic system 45. It can also be made of materials to include hard rubber, nylon, polycarbonate or other plastics. It can have one or more holes or attachment means (not shown) through the central axis or in other locations.

Cylindrical form 104 can have one or more recesses to accept spring plunger 88, a lip (see FIG. 2 IB description) or other element(s) protruding from the part with which it interfaces e.g. alignment block 102.

Figure 21B:
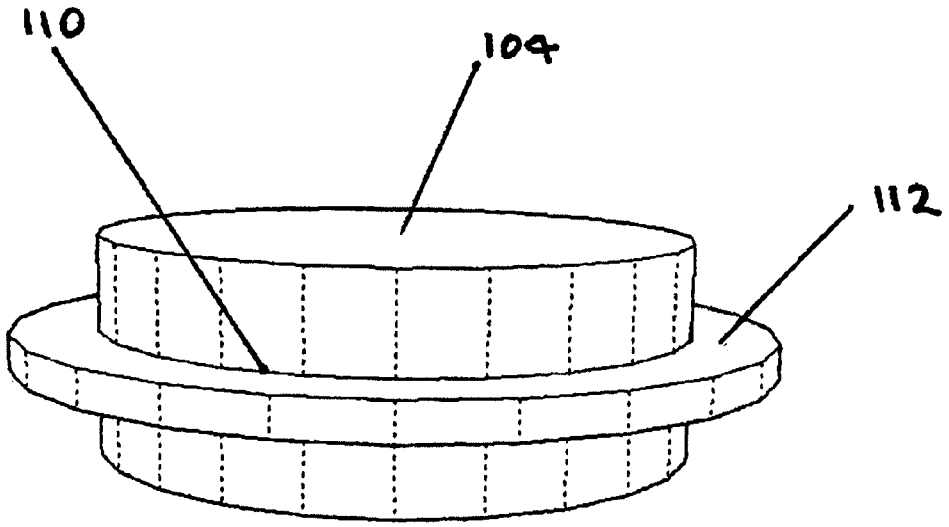
FIG. 21B shows further modifications for the cylindrical form.

FIG. 21B shows further embodiments of cylindrical form 104 from FIG. 21A. Shown set in groove 110 (hidden from view) is a ring 112 which can be manufactured of materials to include metal, spring metal, elastomer, rubber or nylon. The edges of ring 112 can be as shown, alternatively tapered, rounded or of any other shape.

Alternatively, cylindrical form 104 can have a peripheral lip or ridge in the same or a similar location to where ring 112 is shown. This lip or ridge need not extend around the entire circumference, but can be shaped like a tab or tongue (not shown), or multiples thereof. These tabs or tongues can be fixed or can be set in spring mechanisms, similar to spring plunger 88 principles.

There can be several rings 112, lips, ridges and/or grooves 110.

Figure 22:
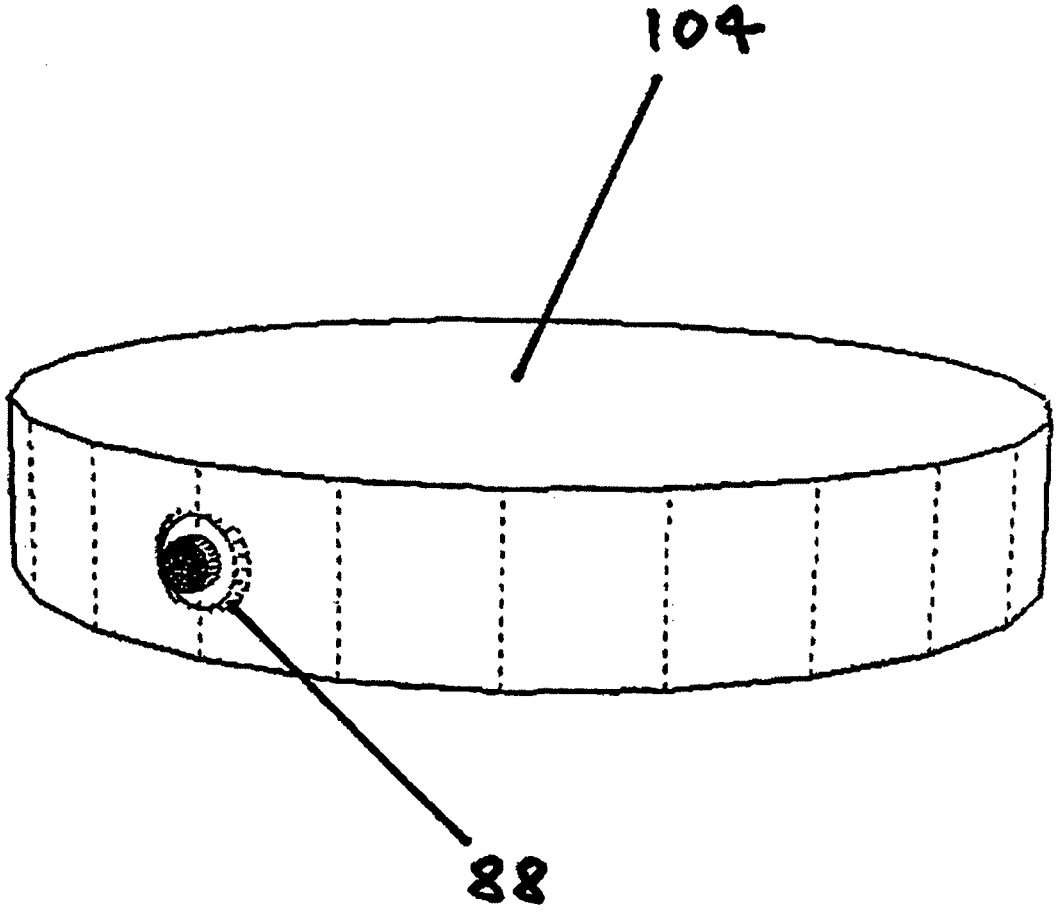
FIG. 22 shows yet a further modification for the cylindrical form.

FIG. 22 shows a further embodiment of cylindrical form 104 with spring plunger 88 set inside, so that just the tip of the plunger protrudes above the surface.

Spring plunger 88 can be substituted by a device having the same function, possibly made of nylon and possibly shaped like a door latch, e.g. flat on three sides and tapered on the fourth.

Alternatively, the device can be tapered on three sides and flat on the fourth, or flat on two sides and tapered on two. Multiple such devices can be arranged in any position on or in cylindrical form 104 and optionally used in combination with other engagement means described.

Figure 23:
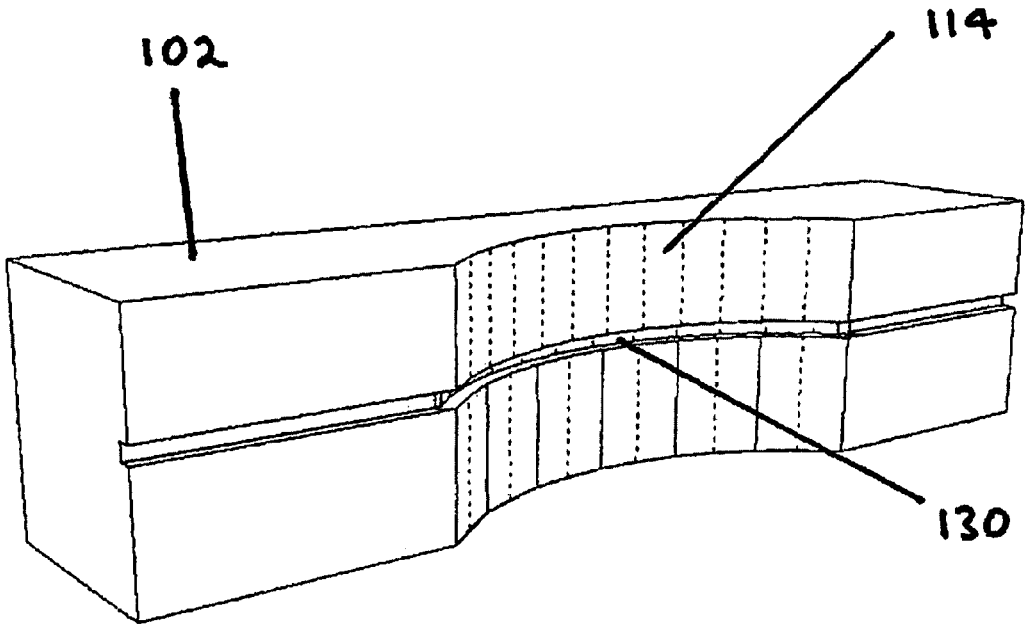
FIG. 23 shows a modification for the alignment block.

FIG. 23 shows alignment block 102 with a partially concave surface 114 which can extend along the entire surface. Alignment block 102 can have one or more grooves 130 which can accommodate ring 112, lip, ridge, tab or tongue protruding from cylindrical form 104, magnet 40 or magnetic system 45.

Alternatively, the construction can be vice versa, with ring 112, lip, ridge, tab, tongue or other protrusion (or multiples thereof) extending from alignment block 102. The protrusion(s) can be fixed or can be set on springs, similar to spring plunger 88 principles. The counterpart(s) would be configured with the appropriate recess(es). There can be multiple grooves, recesses and/or protrusions.

Some or all faces of alignment block 102 can be flat with optionally any of the mentioned features, e.g. groove 130, ridge, tab, lip, tongue, pin, etc. A truncated cylinder shape can be chosen instead of cylindrical form 104. In which case, the curved and/or flat surfaces can be equipped with the mentioned features and/or their counterparts. There can optionally be facilities to take e.g. spring plunger 88.

Figure 24:
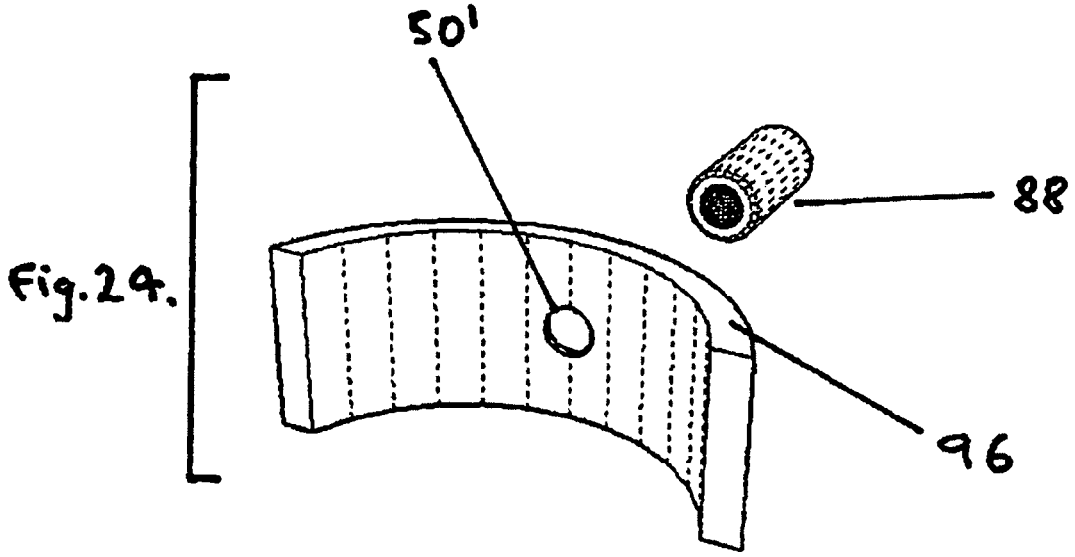
FIG. 24 shows a piece of the cap with a spring plunger.

FIG. 24 shows in perspective a piece cut from cap wall 96 with hole 50'. Spring plunger 88 is mounted in shoe block 66 (not shown). After cap 52 has been inserted into shoe block 66 the ball end of spring plunger 88 protrudes through hole 50'. The ball can interface with a hole or recess in cylindrical form 104 or magnetic system 45. Spring plunger 88 can be substituted by any similar mechanism, possibly shaped like a door latch, e.g. flat on three sides and tapered on the fourth. Alternatively, it can be tapered on three sides and flat on the fourth, or flat on two sides and tapered on two.

Operation

FIGS. 20-24—Alternative Embodiment and Further Optional Modifications

The embodiment shown in FIG. 20 can be used alone or preferably in combination with some of the optional elements, especially those described under FIGS. 21-24. Pivoting and non-pivoting options are available.

In operation, the male member(s) whether spring loaded or not, engage with the complementary recess(es), grooves, slots, etc.

An engagement might be formed with only one of the alignment blocks 102, as the ring 112/lip/tab need not extend around the whole circumference. E.g. If that is the forward facing block (i.e. left) then the user inserts his or her foot at an angle with the toes closest towards the attachment. By pushing down on the heel an engagement will be established. By lifting and/or twisting the foot the engagement can be released.

If ring 112/Hp/tab extends around the circumference, then the material chosen might be so designed to allow a pop-fit within the complementary recess. When a certain force is applied, by lifting, twisting or pulling on the foot, the engagement will release. Spring plunger(s) 88 would function similarly, regardless of their position or number.

If magnetism is used to accomplish the attachment of the parts, either solely or in combination with other modifications shown, then adjustment device of FIG. 2 might be used.

The operation will be similar to that just described.

Button(s) 70, pin(s) or other means or physical constraints can be used to adapt the operation from pivoting to non-pivoting.

This embodiment described in FIGS. 20-24 might offer a lighter weight system than alternative embodiments.

FIG. 25

Further Alternative Modification

Figure 25:
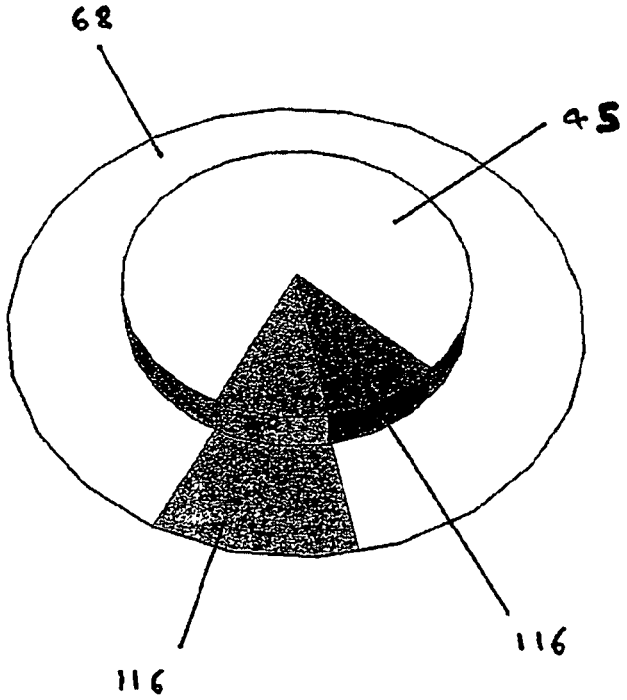
FIG. 25 shows a twisting construction to adjustably reduce the magnetic force.

FIG. 25 shows a rear perspective view of magnetic system 45 placed over ferrous counter plate 68, both being shown of arbitrary shape, size and dimensions. Magnetic system 45 and counter plate 68 are masked in one or more areas (two circular sectors 116 are shown) on facing surfaces with a non-ferrous material. Note: both circular sectors 116 illustrated extend to the center, which cannot be easily seen in the drawing.

Usually, masked areas 116 will be in direct contact with each other. For illustrative purposes only, sector 116 is shown on the bottom of magnetic system 45.

Masked areas can be of any shape.

Operation

FIG. 25—Further Alternative Modification

When magnetic system 45 and/or counter plate 68 rotate and masked areas 116 align, the magnetic force will be reduced. Optionally, a pin (not shown) can be mounted in counter plate 68 to engage with another surface, e.g. base plate 48 to enable the rotation described.

This modification can be used in combination with any embodiment containing magnets and would enable an easier separation of the parts.

FIG. 26-27

Further Alternative Embodiments

Figure 26:
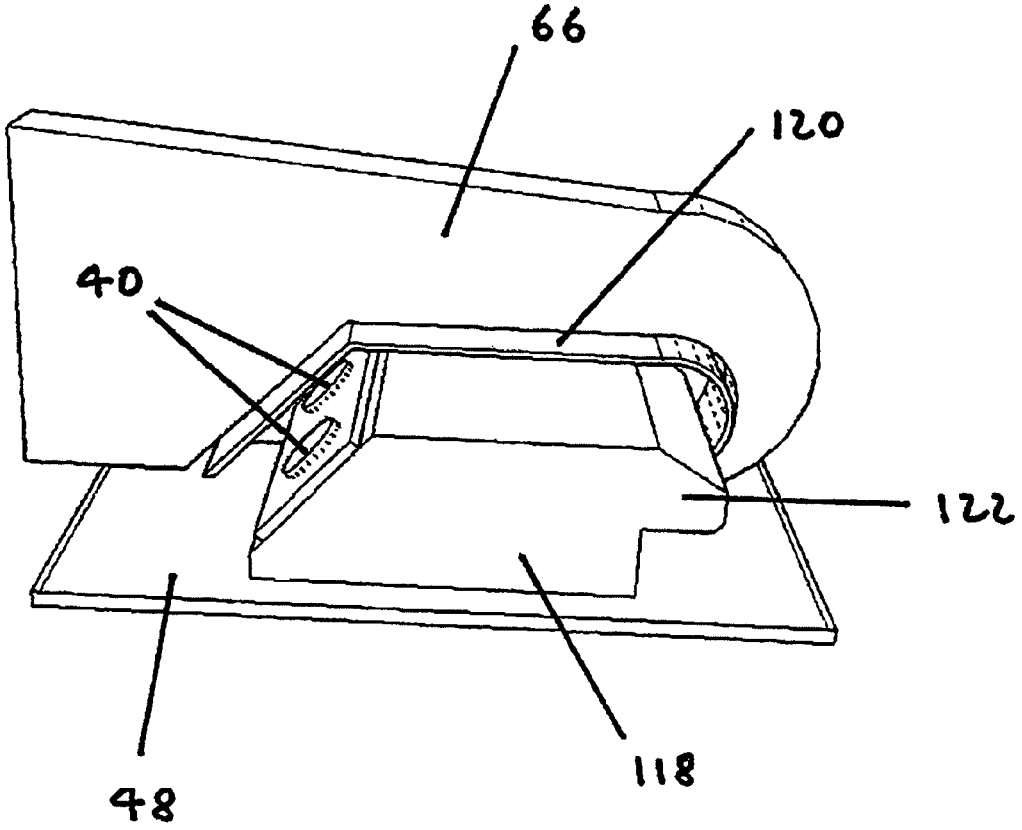
FIG. 26 shows a partial cross section of a mounting block and lip assembly according to another embodiment.

FIG. 26 shows a mounting block 118 attached to the item of sports equipment, foot plate (not shown), foot stretcher (not shown) or base plate 48. Mounting block 118 has a protruding lip 122 on the forward edge (right) and optionally one or more magnets 40 mounted on the upper trailing edge (left). Mounting block 118 hooks into a recess made in shoe block 66, shown here in the stylized form of a shoe (not to scale).

A strip of ferrous metal 120 is mounted in the recess of shoe block 66 and serves as a counter plate for magnet(s) 40 and a tongue which curls under mounting block lip 122. Lip 122 is optionally constructed to break off when subjected to a certain force.

Alternatively, the claw of shoe block 66 which curls under protruding lip 122 can be manufactured of a strong material to substitute the tongue on ferrous metal strip 120. Alternatively, the claw can be made to break away under force.

Mounting block 118 can be manufactured from a material to include metal, plastic or carbon fiber.

Figure 27:
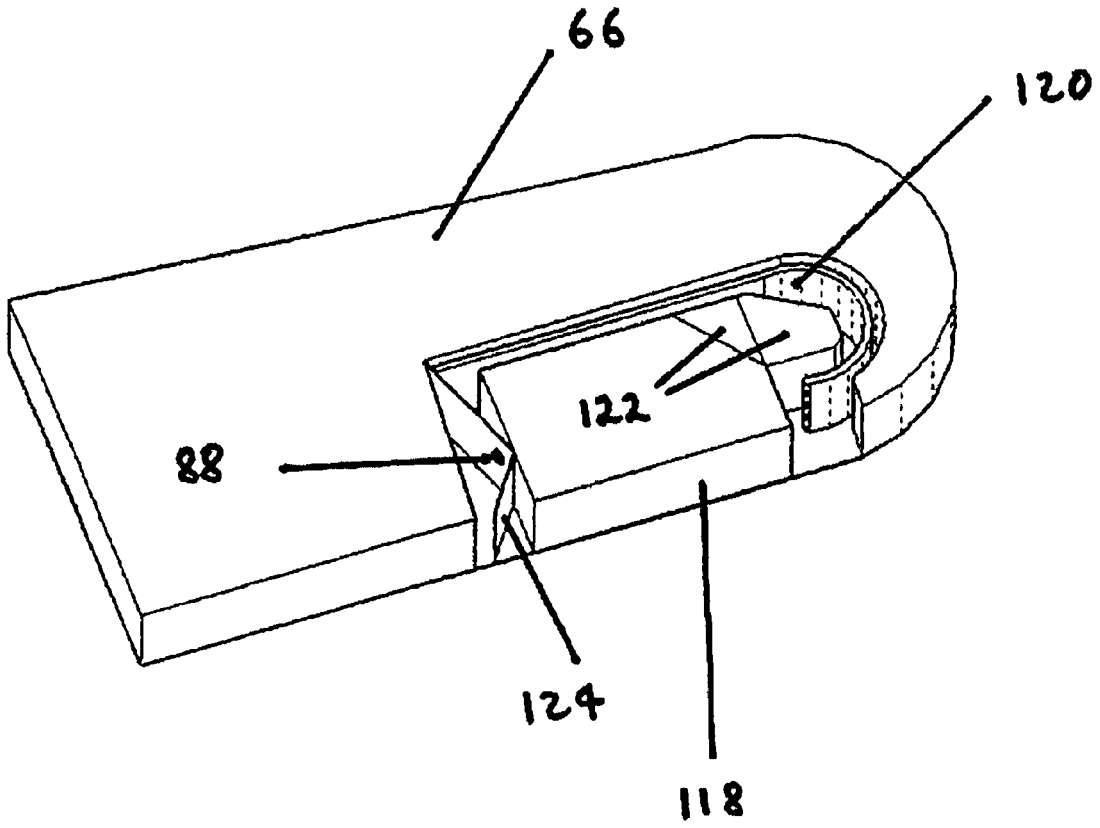
FIG. 27 shows a partial cross section of a similar mounting block and lip assembly with optional spring plunger fastening.

FIG. 27 shows a similar embodiment to FIG. 26 but differs as follows. Spring plunger 88 is mounted in mounting block 118 and interlocks with a spring clip 124 mounted on shoe block 66. Alternatively spring plunger 88 can be substituted by a lip or tongue (or multiples thereof) attached to a similar spring mechanism. An appropriately shape orifice to accept lip or tongue would be provided on spring clip 124 or an alternative suitable counterpart.

Optionally a magnet 40 (not shown) can be integrated on the top of mounting block 118 facing ferrous metal strip 120.

Operation

FIGS. 26-27—Further Alternative Embodiments

Mounting block 118 of FIG. 26 or 27 is attached to base plate 48 which is attached to the foot stretcher or a foot plate or directly to an item of equipment. A shoe is equipped with modified shoe block 66 or the elements of modified shoe block 66 are incorporated in a shoe.

To use these embodiments, the user extends his or her leg beyond mounting block 118 with foot outstretched. The shoe is then hooked into lip 122 of mounting block 118 and the heel is pushed firmly down to engage. When alighting, the heel is lifted to ease detachment.

In the event of capsizing, the weight of the rower will cause the parts to separate. If incorporated, the breakaway part of lip 122 or breakaway part of claw of shoe block 66 will detach at that time.

FIGS. 28-30

Miscellaneous Attachments

Figure 28:
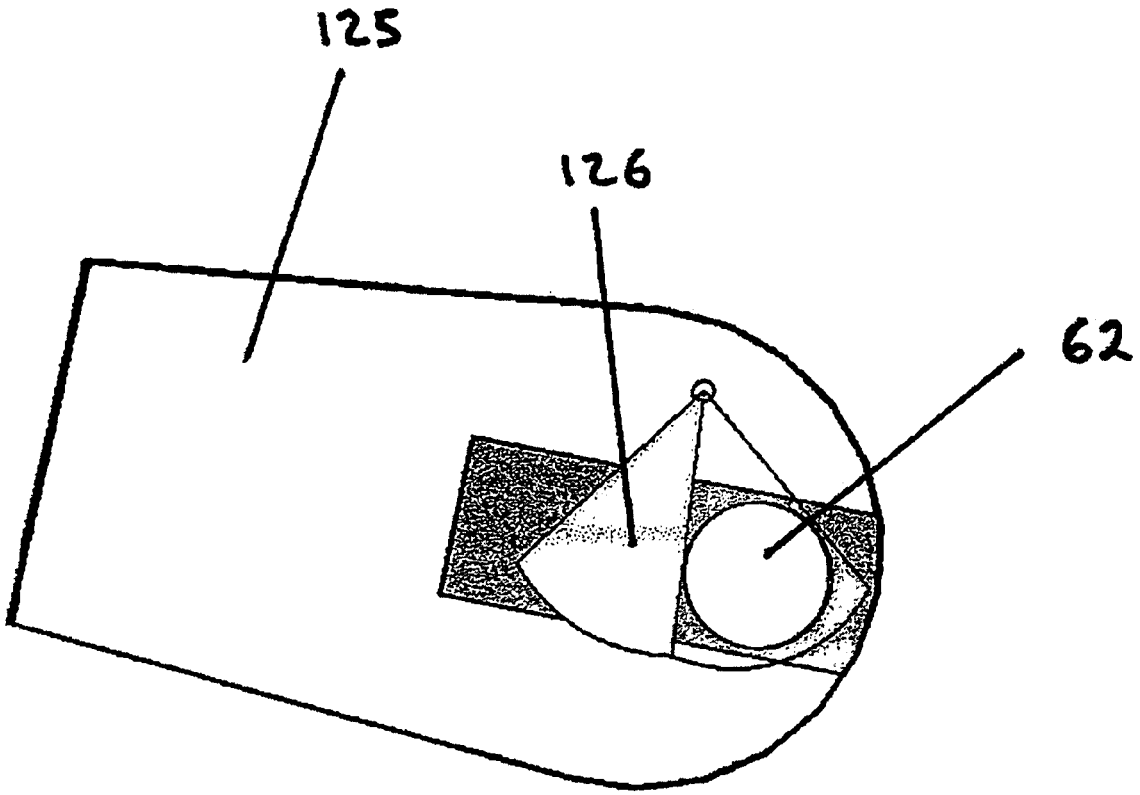
FIG. 28 shows a dirt cover assembly with a circular sector shape.

FIG. 28 shows sole of shoe 125 (not to scale), shoe block assembly of FIG. 3 (shaded rectangle), a circle and a sector dirt cover 126 in the shape of a circular sector. The circle represents either recess 62 in shoe block 66 or it represents cylindrical form 104. Sector dirt cover 126 is pivoted and shown in the left hand position, giving access to recess 62 or cylindrical form 104. When cover 126 is pivoted to the right, it closes the access. Cover 126 is contained within shoe block 66 or shoe sole 125. A button (not shown) or other suitable part can protrude through the outer sole to enable the closing operation.

Sector dirt cover 126 can be designed in any other shape and placed in any convenient location on any embodiment.

Figure 29:
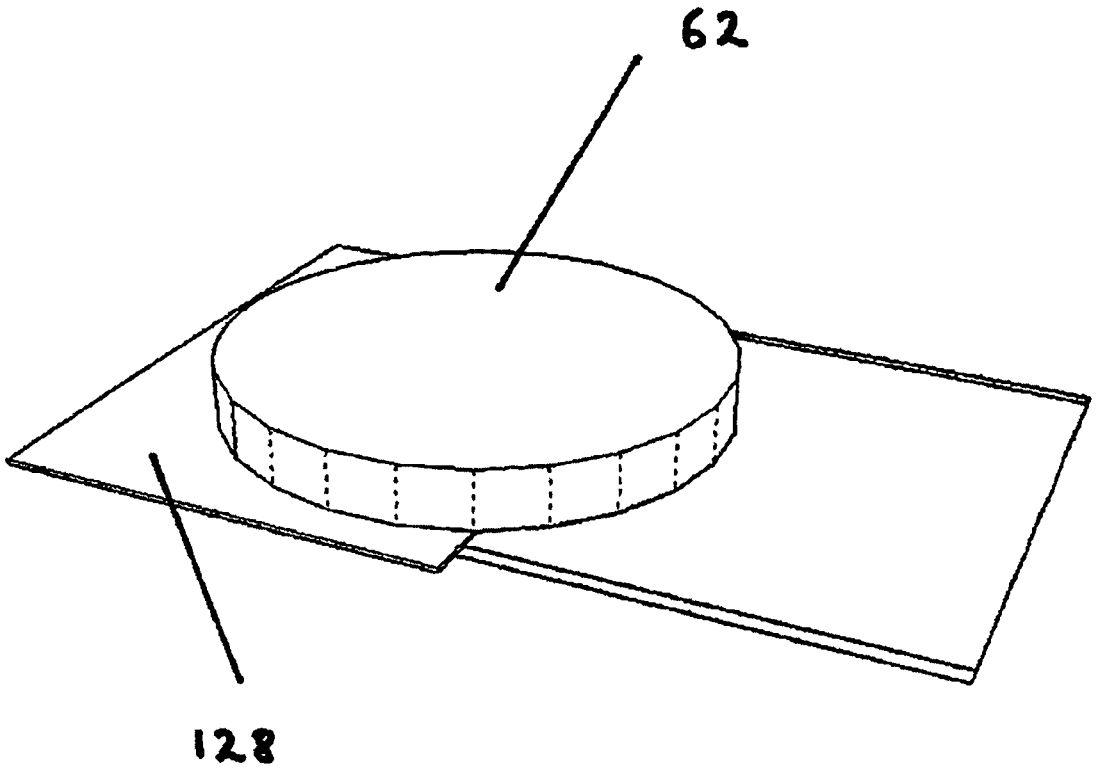
FIG. 29 shows a dirt cover assembly with a sliding hatch.

FIG. 29 shows an alternative way of closing any recesses in shoe block 66 or shoe sole 125 and includes a sliding hatch 128. Sliding hatch 128 can be mounted on shoe block 66, into or onto shoe sole 125. Alternatively, part of sole 125 can be designed to slide and thereby cover any recesses (not shown).

For simplicity this illustration merely shows shoe recess 62 partially covered by sliding hatch 128. Sliding hatch 128 construction can be designed in any other shape and placed in any convenient location on any embodiment.

Figure 30:
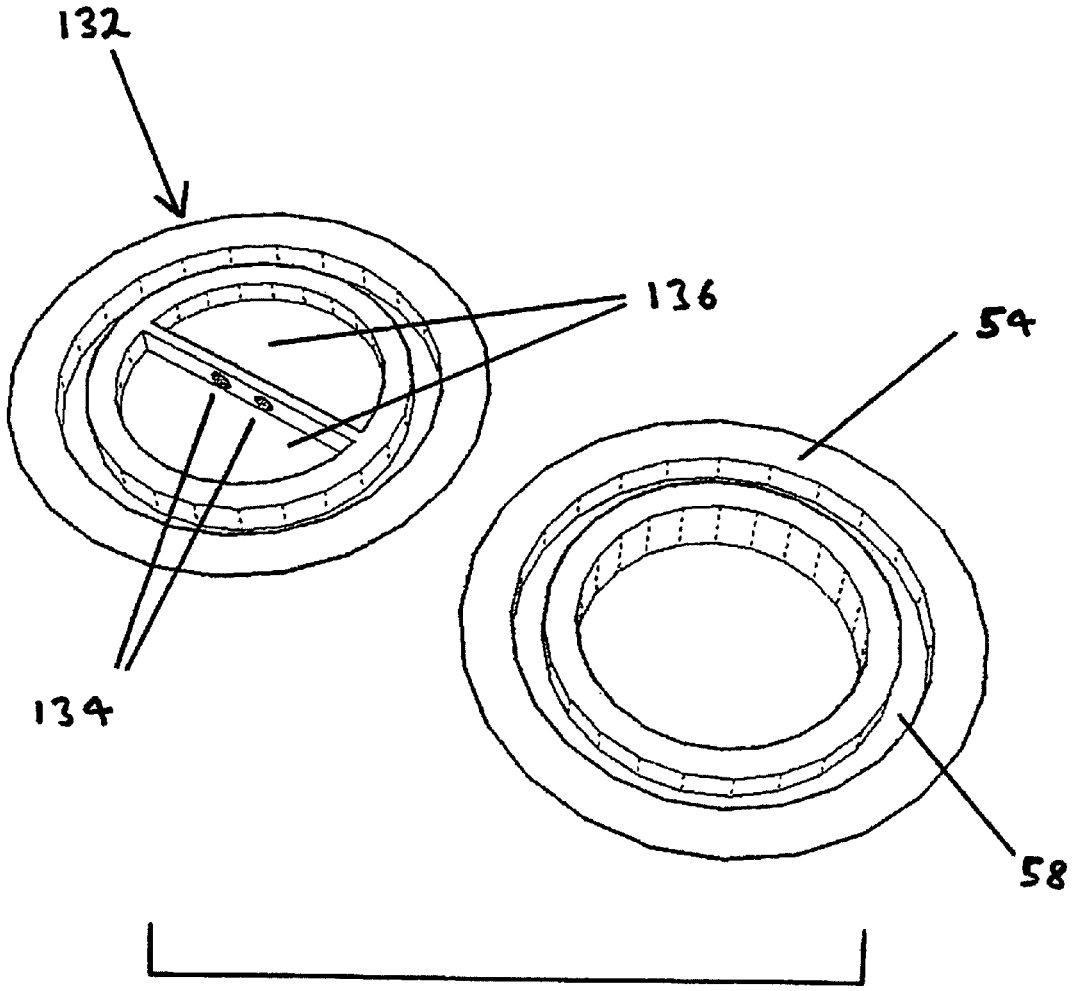
FIG. 30 shows a dirt cover assembly with an optional magnetic closure together with an adjustment device.

FIG. 30 shows adjustment device of FIG. 2 on the right with attachment plate 54 in circular form.

Left of FIG. 30 shows cap cover 132 which fits over adjustment device of FIG. 2 and seals with channel 58 in attachment plate 54.

A finger grip 134 eases removal of cap cover 132 from adjustment device of FIG. 2. The under side of cap cover 132 can be equipped with a magnet (not shown). The grip surrounds 136 can be spring-loaded so that they spring up flush with the surface, hiding finger grip 134. Grip surrounds 136 can be covered with a tread similar or different to that used on the remainder of the outer sole of the shoe.

Alternatively or additionally, a bayonet fitting can be incorporated to attach cap cover 132 to adjustment device of FIG. 2.

Operation

FIGS. 28-30—Miscellaneous Attachments

The operation of the figures is self-explanatory. All solutions serve to keep the embodiments clean.

FIGS. 31-33

Further Alternative Embodiments

Figure 31A:
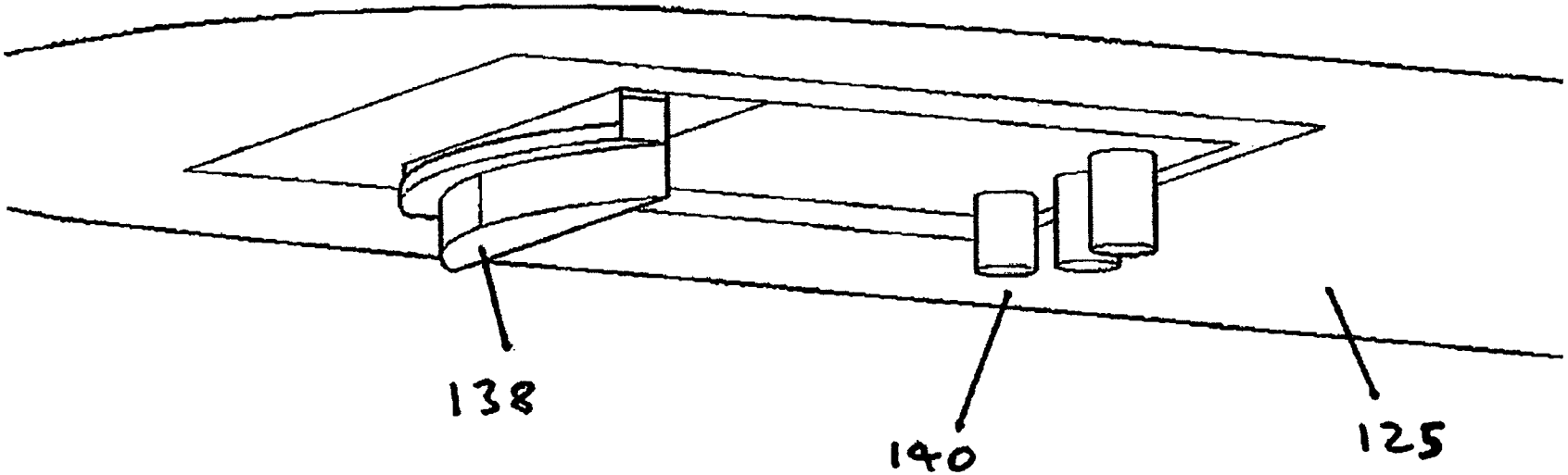
FIG. 31A shows a perspective view of an engagement piece and alignment studs.

FIG. 31A shows a different embodiment. An engagement piece 138 and one or more alignment stud(s) 140 are recessed in sole of shoe 125. (Shown here proud of the surface). They might be attached to the shoe or they might be integrated within the shoe or within shoe sole 125.

Alignment stud(s) 140 can have any suitable form and might be rounded or conical at the tip. The tip and/or the shaft might have one or several scalloped grooves down their length (not shown).

Figure 31B:
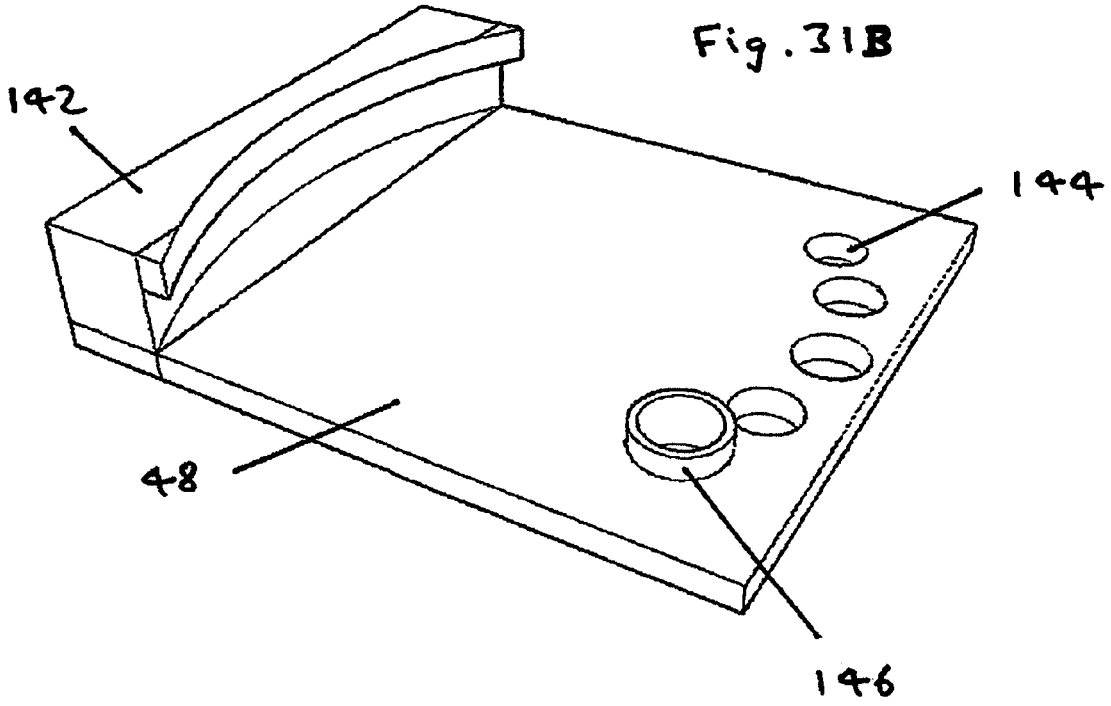
FIG. 31B shows a base plate with receiving form and alignment holes.

FIG. 31B shows base plate 48 with a receiving form 142 left and one or more alignment holes 144 right with optional sleeve(s) 146. The recess in receiving form 142 may have holes or slots (not shown) to take suitably formed protrusions (not shown) extending from engagement piece 138. There might also be a lip (not shown) on engagement piece 138 which hooks upwardly and engages in receiving form 142. Parts of FIG. 31A may be made individually or manufactured in one piece; likewise parts of FIG. 3 IB. Base plate 48 might be attached to foot plate, foot stretcher or item of equipment via pivotal attachment 94 (not shown).

There may be any number of alignment studs 140 and/or alignment holes 144.

Figure 32A:
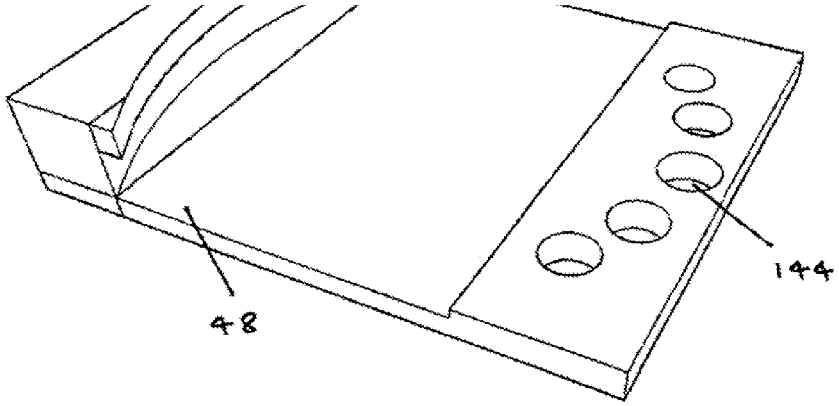
FIG. 32A shows base plate with a modified alignment hole area.

FIG. 32 A shows that the surface of base plate 48 might be of a different height in the alignment hole 144 area. Base plate 48 might be attached to foot plate, foot stretcher or item of equipment via pivotal attachment 94 (not shown).

Figure 32B:
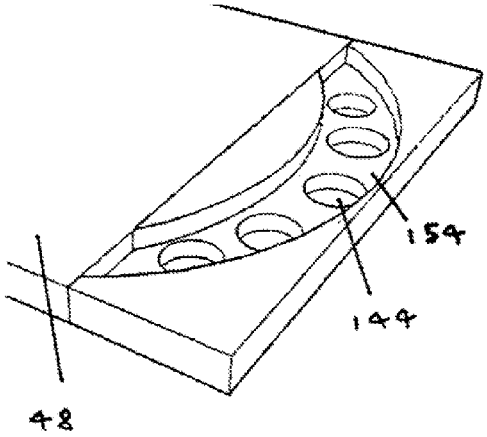
FIG. 32B shows base plate with another modified alignment hole area.

FIG. 32B shows alignment hole 144 area recessed in base plate 48 and forming an arcuate shaped alignment recess 154. Alignment holes 144 might be open to allow dirt to pass through. This can be accommodated for on the foot stretcher, by providing appropriate orifices. Alignment recess 154 is shown contained at each end. Alignment holes 144 are optional. Base plate 48 might be attached to foot plate, foot stretcher or item of equipment via pivotal attachment 94 (not shown).

Figure 32C:
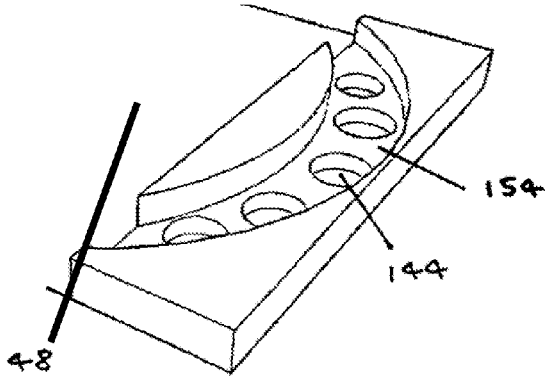
FIG. 32C shows base plate with a yet another alignment hole area.

FIG. 32C is similar to FIG. 32B, but alignment recess 154 as shown is not contained at either end, but might be contained at one end and not at the other. Alignment holes 144 are optional. Base plate 48 might be attached to foot plate, foot stretcher or item of equipment via pivotal attachment 94 (not shown).

Figure 33A:
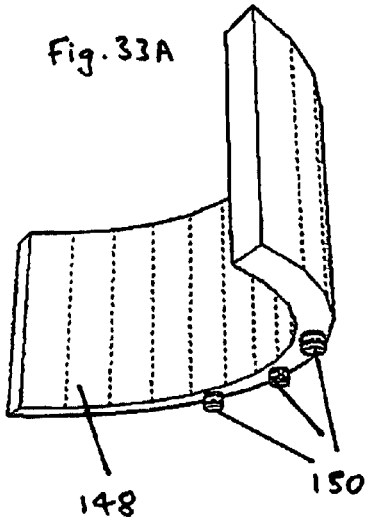
FIG. 33A shows an alignment arc.

FIG. 33 A shows an alignment arc 148 as substitute for alignment stud(s) 140 and can be dimensioned as suited. It might be detachable or attachable to shoe sole 125 in different positions or manufactured as part of shoe sole 125 and be provided in different sizes and or/orientations. One or more nipple(s) 150 can be optionally incorporated on alignment arc 148. Multiple nipples 150 might be attached to each other and might be retractable within alignment arc 148, perhaps by means of an adjustable slide (not shown).

Figure 33B:
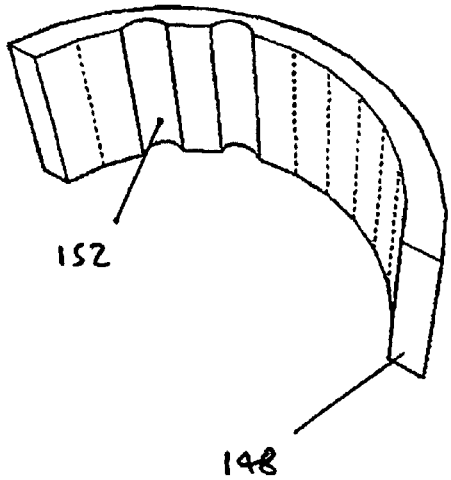
FIG. 33B shows an alignment arc with grooves.

FIG. 33B shows alignment arc 148 with one or more scalloped grooves 152 on the concave side. The scallop 152 can be formed down the entire height of alignment arc 148 or just part.

Figure 33C:
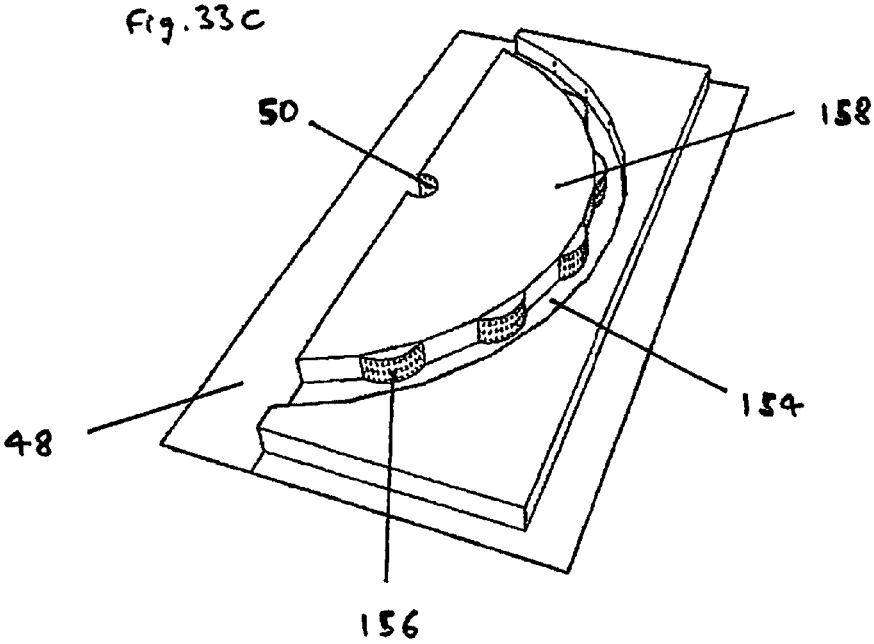
FIG. 33C shows a modified alignment recess.

FIG. 33C shows alignment recess 154 of arcuate shape with optional convex protrusions 156 on the outside convex edge of an alignment segment 158. Convex protrusions 156 could be in any number and position. Optionally, alignment segment 158 is allowed to swivel around pivotal attachment 94 or spindle 98 (not shown) for which hole 50' is provided. If alignment segment 158 is not semicircular, then its body will be extended to reach at least the centre of the circle from which it describes a part in order to provide a means for swiveling around the same axis as that formed by alignment recess 154. An orifice must be provisioned in base plate 48 for spindle 98 (if used) to pass through. Spindle 98 is attached to steering wires (not shown) which connect to the rudder (not shown).

Operation

FIGS. 31A-32C—Further Alternative Embodiments

In a similar manner to other embodiments, there are two upper parts and two lower parts. Here the upper part is attached to, or integrated on, or within each shoe sole 125, and two lower parts are attached either directly to item of equipment or via base plates 48 to foot plate (not shown), foot stretcher (not shown), or piece of equipment (not shown).

To attach the shoe, the toe is pointed forward to introduce engagement piece 138 into receiving form 142.

The heel is moved downwards and alignment studs 140 are pushed into alignment holes 144. Five alignment holes 144 with three alignment studs 140 would e.g. allow the user to select one of three positions to align his or her foot.

To release the foot, the heel is lifted and pulled towards the body. In the embodiment shown in FIG. 32C without containment, the foot can be swiveled left or right to free the engagement. If used with studs 140 or nipples 150, the heel needs to be lifted as with the other embodiments.

Notes FIGS. 31-33. One or more from the list of alignment stud 140, receiving form 142, alignment hole 144, sleeve 146, alignment arc 148, nipple 150, scallop 152, alignment recess 154, convex protrusion 156, and alignment segment 158 could be magnetic or partially have magnetic properties.

Operation FIGS. 32B-33A

Attachment of the shoe is carried out in a similar fashion. If alignment arc 148 without nipple(s) 150 is used, it is merely pushed down into alignment recess 154 when the heel of the shoe is moved downwards.

Depending on the size of alignment arc 148 and positioning on or within the shoe, the amount of swivel can be selected.

Operation FIGS. 33B-33C

Operation as in FIGS. 31A-33A. To enter, by means of the scallops 152, the user has a choice of foot positioning. To exit, the heel must be lifted. In the steering version of the embodiment shown in FIG. 33C, the operation is similar. The initial foot alignment can be chosen in the same way. Thereafter, if it has a swiveling function (steering version), by twisting the foot, spindle 98, connected to the rudder via wires, will turn and steer the boat.

The embodiments shown in FIGS. 31-33 might prove to be more useful if weight of the device is important.

FIG. 34

Further Modification

Figure 34:
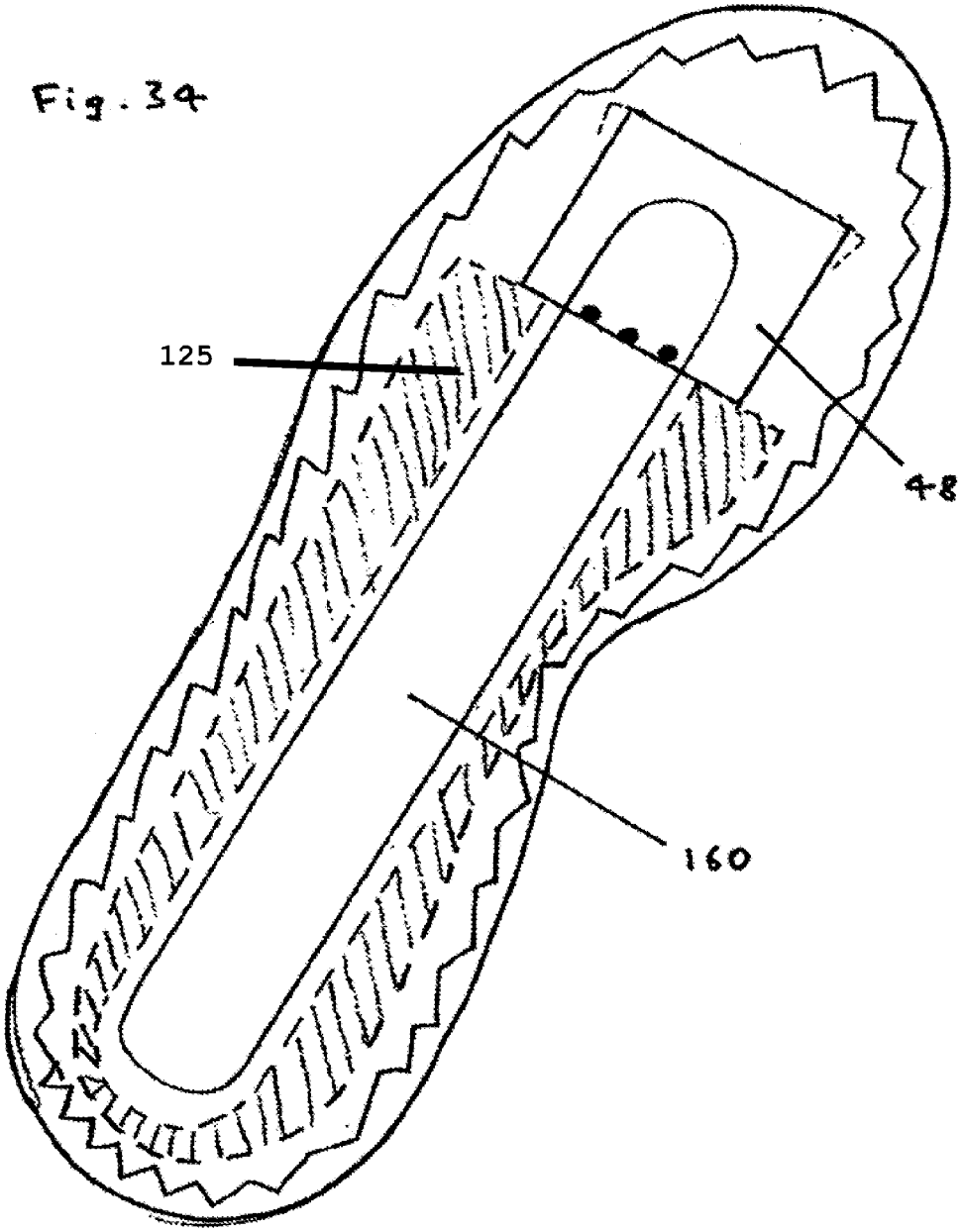
FIG. 34 shows a modification for any embodiment.

FIG. 34. Any embodiment might be accompanied by this modification. A shoe support 160 is shown behind base plate 48 and attachment device. Attachment device refers here to attachment device of FIG. 1 or of any embodiment. Shoe support 160 can take any shape. It might form part of mounting plate 48, be firmly attached to foot plate, foot stretcher or piece of equipment, be set in the same plane, at any angle or incline, alternatively be hinged to any of them.

A trough in sole of shoe 125 could accommodate shoe support 160.

As in other embodiments, mounting plate 48 might pivot.

Optionally a U-shaped form can be provided which slots over shoe support 160.

Embodiments of Shoe and Foot Stretcher

Description of Shoe—not Shown

Some embodiments of my shoe attachment system can be used with existing sports shoes to save cost but those are not optimally designed for this sport. The greatest advantages can be realized in combination with custom made detachable shoes, which are purpose built for the sport but are not yet available on the market.

My shoe has a contoured inner sole with a preferably hard and non-slip outer sole, optimized to grip onto wet and slippery surfaces. The heel will not have a bulky construction like regular sport shoes and the ankle will be low cut and preferably tight fitting, possibly injection molded.

The entire sole, made of a material which can include plastic or carbon fiber will be very stiff except in an area across the shoe in front of and/or behind the ball of the foot. Hinges or other means can be incorporated to increase torsional stiffness. The lower part of the shoe will preferably be stiff and can optionally be designed to offer good arch support.

In one embodiment shown in FIG. 34, the perimeter of the sole has a tread (drawn as a zig-zag pattern) and/or studs with some cushioning, the depth of which could be less that the depth of shoe support 160. This means that the force exerted by the user is concentrated on shoe support 160 and attachment device and the tread need not touch the surface of the foot stretcher. Studs and/or tread might be placed in different areas of shoe sole 125.

Other features might include:

The shoe can be optimized for any embodiment of any attachment system.

The upper, perhaps made from micro fiber, can be fastened at the front with one or more hook and loop fastening straps.

Breathability and/or antibacterial functions will be incorporated where possible.

The outer sole can have different characteristics and possibly different tread in some areas than others. The hardness of the tread can be varied throughout the outer sole.

Instead of or in addition to a contoured inner sole, this shoe can have the facility to enable orthotic inserts to be used. These can serve to compensate for varying lengths of the legs, which is quite common and which can results in back problems if left uncorrected. Also, additional corrections for inadequate foot stretchers can be compensated for via the inserts, if this cannot be accomplished with a contoured inner sole, a very stiff sole, or differences in the tread hardness as mentioned above. This might also help to accommodate for inadequate heel support.

Optionally a corrosion-resistant plate can be inserted in the sole.

Optionally a ring can be incorporated at the back of the heel.

Optionally drainage holes.

Optionally screw holes with or without bushes can be incorporated in the sole.

Any parts of the shoe sole 125 that touch attachment device, shoe support 160, the foot stretcher and/or the piece of equipment can have an anti-slip 'grid' profile with an optional and corresponding counterpart pattern on the facing surface.

Sole of shoe 125 can be made from a non-slip material to afford grip to wet surfaces.

Different types of tread can be applied to sole of shoe 125.

An alternative shoe embodiment will be generally soft, but can retain the hard sole, non-slip outer-sole and optionally the other features.

A soft sole will be offered as an option on either version.

An alternative shoe embodiment will have a medium stiffness sole and an adaptation facility using different orthotic inserts of varying stiffness.

This shoe can be used independently or together with my shoe attachment embodiments.

Operation of Shoe

The operation of these shoes will be clear from reading the descriptions of my shoe attachment embodiments.

These shoes will provide better replacements for shoes currently used and will further enhance the benefits of the shoe attachment embodiments discussed herein.

Description of Foot Stretcher—not Shown

My foot stretcher provides an easier fixation to the boat than is often available. Quick release foot stretcher bolts with cam handles or similarly fast adjustment features will be incorporated.

The foot stretcher will utilize elements preferably stiffer than found on models currently sold, which often use aluminum tubing.

Furthermore, it will be optimized for any of the shoe attachment embodiments discussed herein. A selection of suitable materials for making the foot stretcher include corrosion-resistant steel, ferritic stainless steel, titanium, carbon fiber and/or thermosetting resin, although others can be chosen.

The area of the foot stretcher can be minimized by using footpads for the front part of the feet together with heel pads.

Operation of Foot Stretcher

My foot stretcher will simply be substituted for those currently in use.

It will be optimized for any embodiment of my shoe attachment system. It will help to overcome the shortcomings of the status quo foot stretchers that often lack stiffness and require too much time to adjust.

My shoe attachment embodiments can be used with regular foot stretchers, but my foot stretcher will offer the best experience.

CONCLUSION, RAMIFICATIONS AND SCOPE

Although the descriptions above contain many specific details, these should not be construed as limiting the scope of the embodiments but merely providing illustrations of some of the presently preferred embodiments. Many other variations are possible.

A rare-earth magnet is currently described in Wikipedia as follows: "Rare-earth magnets are strong, permanent magnets made from alloys of rare-earth elements." Rare-earth elements are currently described in Wikipedia such: "According to IUPAC, rare-earth elements or rare-earth metals are a collection of seventeen chemical elements in the periodic table, namely scandium, yttrium, and the fifteen lanthanoids."

Any magnets used in these embodiments, need not be rare earth magnets, even if they bear the number 40 in the figures and descriptions.

In any embodiments, magnetic system 45 or cylindrical form 104 can being mounted to base plate 48, foot plate, foot stretcher or directly on to an item of sports equipment. Alternatively, they can be set partially or completely below the surface of the items.

Base plate 48 can be mounted to foot plate, foot stretcher or item of sport equipment. Base plate 48 can however alternatively be formed as a wedge or a wedge shaped piece of material can be mounted onto it. As a result, the foot would push off from the sports equipment at an angle.

Base plate 48 might be attached to foot plate or foot stretcher using attachment hole configurations commonly found in the field. This should not exclude base plate 48 being optionally fitted with a slide to allow the shoes to be located in a non-standard position.

Base plate 48 can also be dispensed with and the parts which would have been attached to or integrated with it, can be attached to or integrated directly with the foot plate, foot stretcher or the piece of equipment.

Pivoting can also mean partly pivoting, i.e. a pivoting function need not infer 360 degrees. In this document, pivoting and swiveling are deemed to mean the same.

Other releasable attachments include but are not limited to: hook-and-loop style attachments, magnets, snaps, adhesives, grooves, dovetails, etc.

All interlocking/connecting parts can be fixed on the other part and vice versa.

In some cases I have listed materials which I currently contemplate. However, these are in no way to be interpreted as being restrictive or exclusive to only using those materials or combinations. The same applies to any dimensions or values given.

The embodiments described can be used to attach shoes to many different items, not merely sports equipment.

The invention claimed is:

1. An attachment system configured to be connected to a shoe and a sports equipment, the attachment system comprising: an attachment device that is connected to a sports equipment, the attachment device having a first structure extending outward therefrom, an adjustment device, and a shoe block assembly adapted to be connected to the shoe and configured to accept the attachment device, wherein the adjustment device comprises at least one of a plurality of interchangeable non-ferrous caps, at least one of said caps is mounted an attachment plate, the attachment plate having a surface and each of said caps having a second structure comprising at least one side wall extending outward from said attachment plate, and a base extending from said at least one said wall to form the second structure with a recess of the at least one of said interchangeable non-ferrous caps, the shoe block assembly having a recess therein that receives the second structure extending from at least one of the said interchangeable non-ferrous caps, the second structure and the recess in the shoe block assembly pivotally assembled for the shoe block assembly configured to be pivotally coupled to the attachment device, wherein the attachment device and the shoe block assembly removably lock together for use of a sports equipment, which provides users better control over a force applied to a sports equipment via the shoe; wherein the shoe block assembly is removably attachable to the attachment device using magnetic force; wherein at least one of the plurality of interchangeable non-ferrous caps of the adjustment device is mounted between the shoe block assembly and the attachment device, and is fixed to the shoe block assembly for selectively adjusting the magnetic force by interchanging the non-ferrous caps, and wherein the second structure and recess of the plurality of interchangeable non-ferrous caps fit over the corresponding first structure of a magnet or magnetic system provided with said attachment device so that the shoe block assembly and the attachment device are separated from each other by at least the base of the at least one of said plurality of interchangeable non-ferrous caps, said plurality of interchangeable non-ferrous caps further having bases with thicknesses that vary a spacing gap between the magnet or magnetic system and that adapts therewith a holding strength of the magnet or magnetic system to the attachment device.

2. The attachment system of claim 1, comprising at least one of a pyramid, wedge-, or elongated wedge-type structures attached to at least one component of the system that causes separation of the shoe block assembly from the attachment device when pivoting the shoe block assembly relative to the attachment device.

3. The attachment system of claim 2, comprising two pyramids, wedges or wedge-type structures coupled to each other.

4. The attachment system of claim 1, comprising a button provided within the shoe block assembly or within the adjustment device for engaging an indent made in the adjustment device or in the attachment device to ensure non-pivoting or limited pivoting function.

5. The attachment system of claim 1, comprising alignment studs provided in a heel area of the shoe block assembly and alignment holes provided in a heel area of the attachment device, said alignment studs engaging the alignment holes in several adjustment positions of the shoe.

6. The attachment system of claim 1, comprising an alignment arc provided in a heel area of the shoe block assembly and an alignment recess provided in a heel area of the attachment device, said alignment arc engaging in said alignment recess.

7. The attachment system of claim 1, comprising an alignment arc provided in a heel area of the shoe block assembly, said alignment arc being provided with downwardly protruding nipples, and further alignment holes provided in a heel area of the attachment device, said alignment nipples engaging said alignment holes in several adjustment positions of the shoe.

8. The attachment system of claim 1, comprising an alignment arc provided in a heel area of the shoe block assembly, said alignment arc being provided with groove-like scallops for engaging an alignment recess provided in a heel area of the attachment device, said alignment scallops engaging one or more convex protrusions extending into the alignment recess to allow for selective adjustment of the shoe.

9. The attachment system of claim 1, comprising a spindle attached to, or removably connected to a base plate, to a magnet, or to a magnetic system, wherein said spindle is connectible with a steering mechanism which controls the direction of a boat.

10. The attachment system of claim 1, comprising a shoe support connected to or forming part of the attachment device or of the shoe block assembly.

11. The attachment system of claim 10, comprising a trough in shoe sole for overlapping contact with the shoe support being connected to or forming part of the attachment device, said shoe support providing a supporting function.

12. The attachment system of claim 1, wherein at least one of the attachment device, shoe block assembly and adjustment device are formed in a manner as to prevent by their geometry any lateral displacement of the shoe relative to a surface to which they are attached.

13. The attachment system of claim 1, comprising means for mating said adjustment device when attached to said shoe block assembly with said attachment device, and enabling left and right feet to rotate in a clockwise or anti-clockwise direction.

14. The attachment system of claim 1, wherein said adjustment device is for limited time use to enhance correct functionality in the event of wear.

* * * * *